US009406996B2

(12) United States Patent
Lee et al.

(10) Patent No.: US 9,406,996 B2
(45) Date of Patent: Aug. 2, 2016

(54) WINDOW ASSEMBLY WITH TRANSPARENT LAYER AND AN ANTENNA ELEMENT

(71) Applicants: AGC AUTOMOTIVE AMERICAS R&D, INC., Ypsilanti, MI (US); AGC Flat Glass North America, Inc., Alpharetta, GA (US)

(72) Inventors: Ming Lee, Ypsilanti, MI (US); Jesus Gedde, Dexter, MI (US); Frederick M. Schaible, III, Grosse Pointe Park, MI (US); Yasutaka Horiki, Ypsilanti, MI (US); Jun Noda, Canton, MI (US)

(73) Assignees: AGC AUTOMOTIVE AMERICAS R&D, INC., Ypsilanti, MI (US); AGC FLAT GLASS NORTH AMERICA, INC., Alpharetta, GA (US)

( * ) Notice: Subject to any disclaimer, the term of this patent is extended or adjusted under 35 U.S.C. 154(b) by 256 days.

(21) Appl. No.: 14/161,466

(22) Filed: Jan. 22, 2014

(65) Prior Publication Data

US 2015/0207203 A1 Jul. 23, 2015

(51) Int. Cl.
*H01Q 1/32* (2006.01)
*H01Q 1/12* (2006.01)

(52) U.S. Cl.
CPC ..... *H01Q 1/1271* (2013.01)

(58) Field of Classification Search
CPC ..... H01Q 1/32
USPC ..... 343/713, 711, 712, 704, 906
See application file for complete search history.

(56) References Cited

U.S. PATENT DOCUMENTS

| | | | |
|---|---|---|---|
| 3,728,732 | A | 4/1973 | Igarashi |
| 3,945,014 | A | 3/1976 | Kunert et al. |
| 4,072,955 | A | 2/1978 | Comastri et al. |
| 4,768,037 | A | 8/1988 | Inaba et al. |

(Continued)

FOREIGN PATENT DOCUMENTS

| | | |
|---|---|---|
| CN | 3660226 | 6/2007 |
| EP | 0 720 249 A2 | 7/1996 |

(Continued)

OTHER PUBLICATIONS

Windscreen Mount Antenna, update Apr. 2011, online: http://www.gerrelt.nl/section-aerodynamics/aerody-windscreen-antenna.html, [site visited Jul. 29, 2015 7:30:57 PM].

(Continued)

*Primary Examiner* — Huedung Mancuso
(74) *Attorney, Agent, or Firm* — Howard & Howard Attorneys PLLC

(57) ABSTRACT

A window assembly includes an electrically conductive transparent layer and an antenna element disposed on a substrate. The antenna element includes a first antenna segment and a second antenna segment. The first antenna segment is elongated and disposed in an outer region devoid of the transparent layer. The second antenna segment extends from the first antenna segment toward the transparent layer such that the second antenna segment crosses a periphery of the transparent layer. The second antenna segment abuts and is in direct electrical contact with the transparent layer. A feeding element is coupled to the antenna element and energizes the first and second antenna segments and the transparent layer such that the first and second antenna segments and the transparent layer collectively transmit and/or receive radio frequency signals.

39 Claims, 12 Drawing Sheets

(56) References Cited

U.S. PATENT DOCUMENTS

| | | | | |
|---|---|---|---|---|
| 4,849,766 | A | 7/1989 | Inaba et al. | |
| 5,005,020 | A * | 4/1991 | Ogawa | B32B 17/10 343/713 |
| 5,132,161 | A * | 7/1992 | Shibata | B32B 17/10174 343/704 |
| 5,142,460 | A | 8/1992 | McAtee | |
| 5,670,966 | A | 9/1997 | Dishart et al. | |
| 5,790,080 | A | 8/1998 | Apostolos | |
| 5,856,035 | A | 1/1999 | Khandkar et al. | |
| 5,898,407 | A | 4/1999 | Paulus et al. | |
| 5,973,648 | A | 10/1999 | Lindenmeier et al. | |
| 5,999,136 | A | 12/1999 | Winter et al. | |
| D434,752 | S | 12/2000 | Kudo | |
| 6,211,831 | B1 | 4/2001 | Nagy et al. | |
| 6,239,758 | B1 * | 5/2001 | Fuchs | H01Q 1/1278 343/704 |
| 6,320,276 | B1 | 11/2001 | Sauer | |
| 6,417,811 | B1 | 7/2002 | Adrian | |
| D490,801 | S | 6/2004 | Iwai et al. | |
| 6,906,287 | B2 | 6/2005 | Sol | |
| D543,974 | S | 6/2007 | Oshima et al. | |
| D544,469 | S | 6/2007 | Oshima | |
| D588,586 | S | 3/2009 | Montgomery et al. | |
| 7,518,558 | B2 | 4/2009 | Kato et al. | |
| D602,010 | S | 10/2009 | Yakubo | |
| 7,656,357 | B2 * | 2/2010 | Ishibashi | H01Q 1/1271 343/713 |
| D615,966 | S | 5/2010 | Shinkawa et al. | |
| D616,163 | S | 5/2010 | Nam et al. | |
| D618,223 | S | 6/2010 | Tsai et al. | |
| D620,857 | S | 8/2010 | Noguchi et al. | |
| D620,858 | S | 8/2010 | Noguchi et al. | |
| D621,819 | S | 8/2010 | Tsai et al. | |
| 7,847,745 | B2 | 12/2010 | Martin | |
| D635,560 | S | 4/2011 | Tsai et al. | |
| D635,964 | S | 4/2011 | Podduturi | |
| D636,382 | S | 4/2011 | Podduturi | |
| 8,004,465 | B2 | 8/2011 | Schano | |
| 8,081,130 | B2 | 12/2011 | Apostolos et al. | |
| 8,268,222 | B2 | 9/2012 | Aisenbrey | |
| 8,269,676 | B2 | 9/2012 | Lin | |
| D675,195 | S | 1/2013 | Huang et al. | |
| 8,350,766 | B2 * | 1/2013 | Hisaeda | H01Q 1/1271 343/704 |
| D676,429 | S | 2/2013 | Gosalia et al. | |
| 8,466,842 | B2 | 6/2013 | Dai | |
| D686,600 | S | 7/2013 | Yang | |
| D689,474 | S | 9/2013 | Yang et al. | |
| 8,576,130 | B2 * | 11/2013 | Dai | H01Q 1/1278 343/712 |
| 8,590,797 | B2 | 11/2013 | Kato et al. | |
| D694,738 | S | 12/2013 | Yang | |
| 8,830,128 | B2 | 9/2014 | Fuchs et al. | |
| 8,906,523 | B2 | 12/2014 | Brantner | |
| 2003/0034927 | A1 | 2/2003 | Deininger | |
| 2003/0230017 | A1 | 12/2003 | Geyer | |
| 2004/0200821 | A1 | 10/2004 | Voeltzel | |
| 2006/0214863 | A1 | 9/2006 | Fujimoto et al. | |
| 2007/0040028 | A1 | 2/2007 | Kawamata | |
| 2008/0068276 | A1 | 3/2008 | Noro | |
| 2008/0079639 | A1 | 4/2008 | Jen-Huan | |
| 2008/0143630 | A1 | 6/2008 | Kato et al. | |
| 2008/0143632 | A1 | 6/2008 | Apostolos | |
| 2008/0158075 | A1 | 7/2008 | Villarroel et al. | |
| 2008/0218417 | A1 | 9/2008 | Gillette | |
| 2008/0258992 | A1 | 10/2008 | Tsai et al. | |
| 2008/0283173 | A1 | 11/2008 | Hisaeda | |
| 2010/0283694 | A1 | 11/2010 | Kato | |
| 2011/0068986 | A1 | 3/2011 | Tezuka et al. | |
| 2011/0241961 | A1 | 10/2011 | Aizawa | |
| 2012/0256798 | A1 | 10/2012 | Paulus et al. | |
| 2012/0280873 | A1 | 11/2012 | Rofougaran | |
| 2012/0306704 | A1 | 12/2012 | Li et al. | |
| 2013/0141297 | A1 | 6/2013 | Gomme et al. | |
| 2014/0361948 | A1 | 12/2014 | Tanaka et al. | |

FOREIGN PATENT DOCUMENTS

| | | |
|---|---|---|
| JP | S 63-155805 A | 6/1988 |
| JP | D 1185796 | 9/2003 |
| JP | D1224231 | 12/2004 |
| JP | D 1263798 | 2/2006 |
| JP | D 1291197 | 1/2007 |
| JP | D 1350409 | 2/2009 |
| JP | D 1421524 | 8/2011 |
| KR | 300552847 | 2/2010 |
| WO | WO 2012/079002 A1 | 6/2012 |

OTHER PUBLICATIONS

English language abstract/description for JPD 1185796 extracted from https://www9.orbit.com/index.html?ticket=2ddf4357-c380-4cdc-ba25-4d0fe264c76d&locale=en&embedded+false &locale=en#DesignFullPage on Jul. 29, 2015, 1 page.

English language abstract/description for JPD 1224231 extracted from https://www9.orbit.com/index.html?ticket=2ddf4357-c380-4cdc-ba25-4d0fe264c76d&locale=en&embedded+false &locale=en#DesignFullPage on Jul. 29, 2015, 1 page.

English language abstract/description for JPD 1291197 extracted from https://www9.orbit.com/index.html?ticket=2ddf4357-c380-4cdc-ba25-4d0fe264c76d&locale=en&embedded+false &locale=en#DesignFullPage on Jul. 29, 2015, 1 page.

English language abstract/description for JPD 1421524 extracted from https://www9.orbit.com/index.html?ticket=2ddf4357-c380-4cdc-ba25-4d0fe264c76d&locale=en&embedded+false &locale=en#DesignFullPage on Jul. 29, 2015, 1 page.

English language abstract/description for KR 200552847 extracted from https://www9.orbit.com/index.html?ticket=2ddf4357-c380-4cdc-ba25-4d0fe264c76d&locale=en&embedded+false &locale=en#DesignFullPage on Jul. 29, 2015, 1 page.

U.S. Appl. No. 29/480,024, filed Jan. 22, 2014, 16 pages.

U.S. Appl. No. 29/480,027, filed Jan. 22, 2014, 16 pages.

International Search Report for Application No. PCT/US2014/012526 dated Oct. 9, 2014, 4 pages.

English language abstract for JPS 63-155805 extracted from PAJ database on Oct. 16, 2014, 1 page.

* cited by examiner

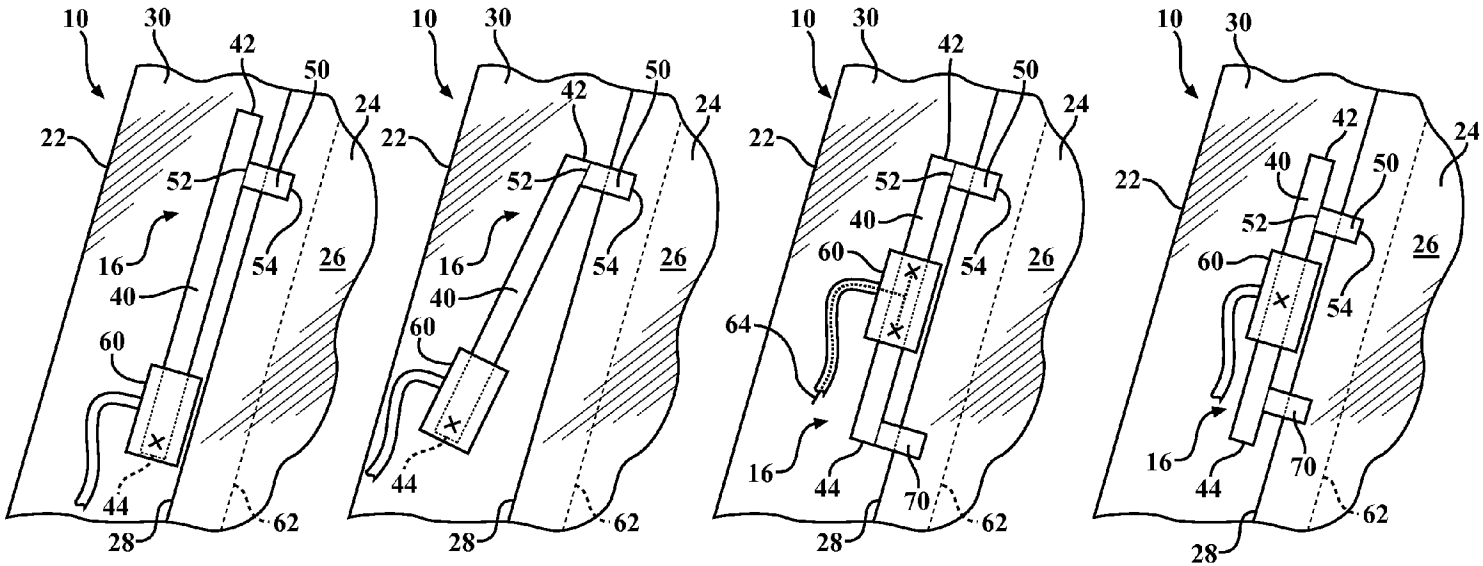
FIG. 7
FIG. 8
FIG. 9
FIG. 10
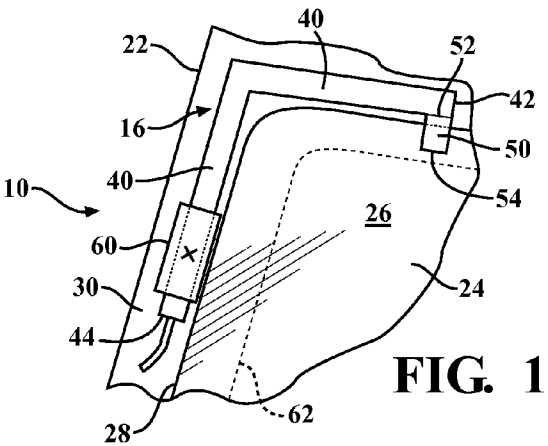
FIG. 11
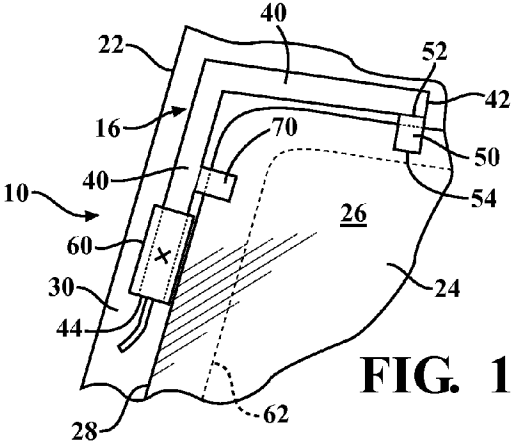
FIG. 12

WINDOW ASSEMBLY WITH TRANSPARENT LAYER AND AN ANTENNA ELEMENT

BACKGROUND OF THE INVENTION

1. Field of the Invention

The subject invention generally relates to a window assembly. More specifically, the subject invention relates to a window assembly having a transparent layer and an antenna element.

2. Description of the Related Art

Recently, there is increasing demand for vehicle windshields having clear films or coatings embedded within the windshield for various purposes. Such clear films or coatings often have metal compounds, such as metal oxides, for making the clear films or coatings electrically conductive. The clear films or coatings have been applied to windshields to reflect heat from sunlight penetrating the windshield. In particular, the clear films or coatings reflect infrared radiation from sunlight. In so doing, the clear films or coatings reduce the amount of infrared radiation entering an interior of the vehicle. As a result, during warm months, less energy is required to lower the interior temperature of the vehicle. To maximize efficiency of the clear films or coatings to reflect infrared radiation, the clear films or coatings are typically applied over a substantial part of the windshield, often spanning the entire field of view of the driver.

Conventional window assemblies have attempted to utilize such clear films or coatings for antenna purposes. However, conventional window assemblies utilizing the clear films or coatings lack robust and efficient antenna performance. Today's vehicles are subjected to ever-increasing electromagnetic interference. Yet, conventional window assemblies utilizing the clear films or coatings insufficiently control antenna radiation patterns and antenna impedance characteristics to combat such electromagnetic interference. Conventional window assemblies utilizing the clear films or coatings fail to sufficiently reduce a footprint of antenna elements utilized in conjunction with the clear film or coating. In utilizing such clear films or coatings for antenna purposes, many conventional window assemblies require costly modifications to the clear films or coatings, such as deletions, voids, or slits that are formed therein for antenna purposes. Moreover, conventional window assemblies lack the ability to further operate the clear films or coatings for defogging or a defrosting element purposes.

Therefore, there remains the opportunity to develop a window assembly that solves the aforementioned problems.

SUMMARY OF THE INVENTION AND ADVANTAGES

A window assembly is provided. The window assembly includes a substrate. The window assembly includes a transparent layer disposed on the substrate. The transparent layer defines an area having a periphery. The transparent layer comprises a metal compound such that the transparent layer is electrically conductive. The window assembly includes an outer region devoid of the transparent layer. The outer region is defined adjacent the transparent layer along the periphery. The window assembly includes an antenna element disposed on the substrate. The antenna element includes a first antenna segment and a second antenna segment. The first antenna segment is disposed in the outer region and spaced from the periphery. The first antenna segment is elongated and extends along the periphery. The second antenna segment extends from the first antenna segment toward the transparent layer such that the second antenna segment crosses the periphery of the transparent layer. The second antenna segment abuts and is in direct electrical contact with the transparent layer. The window assembly includes a feeding element coupled to the antenna element. The feeding element energizes the first and second antenna segments and the transparent layer such that the first and second antenna segments and the transparent layer collectively transmit and/or receive radio frequency signals.

The window assembly advantageously provides robust and efficient antenna performance. The area of the transparent layer provides transmission and/or reception of radio frequency signals. The first and second antenna segments beneficially play a role in transmission and/or reception of radio signals. The first and second antenna segments alter antenna radiation pattern and/or antenna impedance characteristics. Having the first antenna segment disposed in the outer region and spaced from and extending along the periphery advantageously maximizes and improves antenna impedance matching and radiation pattern altering. Moreover, by abutting the transparent layer, the second antenna segment advantageously provides a DC connection between the first antenna segment and the transparent layer. In providing the DC connection, the second antenna segment allows a footprint of the antenna element to be minimized. Moreover, the first and second antenna segments may be applied to the window assembly without any modification to the area of the transparent layer.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 7 is a plan view of the antenna element having the first and second antenna segments, according to one embodiment of the present invention;

FIG. 8 is a plan view of the antenna element having the first and second antenna segments, according to another embodiment of the present invention;

FIG. 9 is a plan view of the antenna element having the first, second, and third antenna segments, according to another embodiment of the present invention;

FIG. 10 is a plan view of the antenna element having the first, second, and third antenna segments, according to another embodiment of the present invention;

FIG. 11 is a plan view of the antenna element having the first and second antenna segments, according to yet another embodiment of the present invention;

FIG. 12 is a plan view of the antenna element having the first, second, and third antenna segments, according to another embodiment of the present invention;

DETAILED DESCRIPTION OF THE INVENTION

Figure 1:
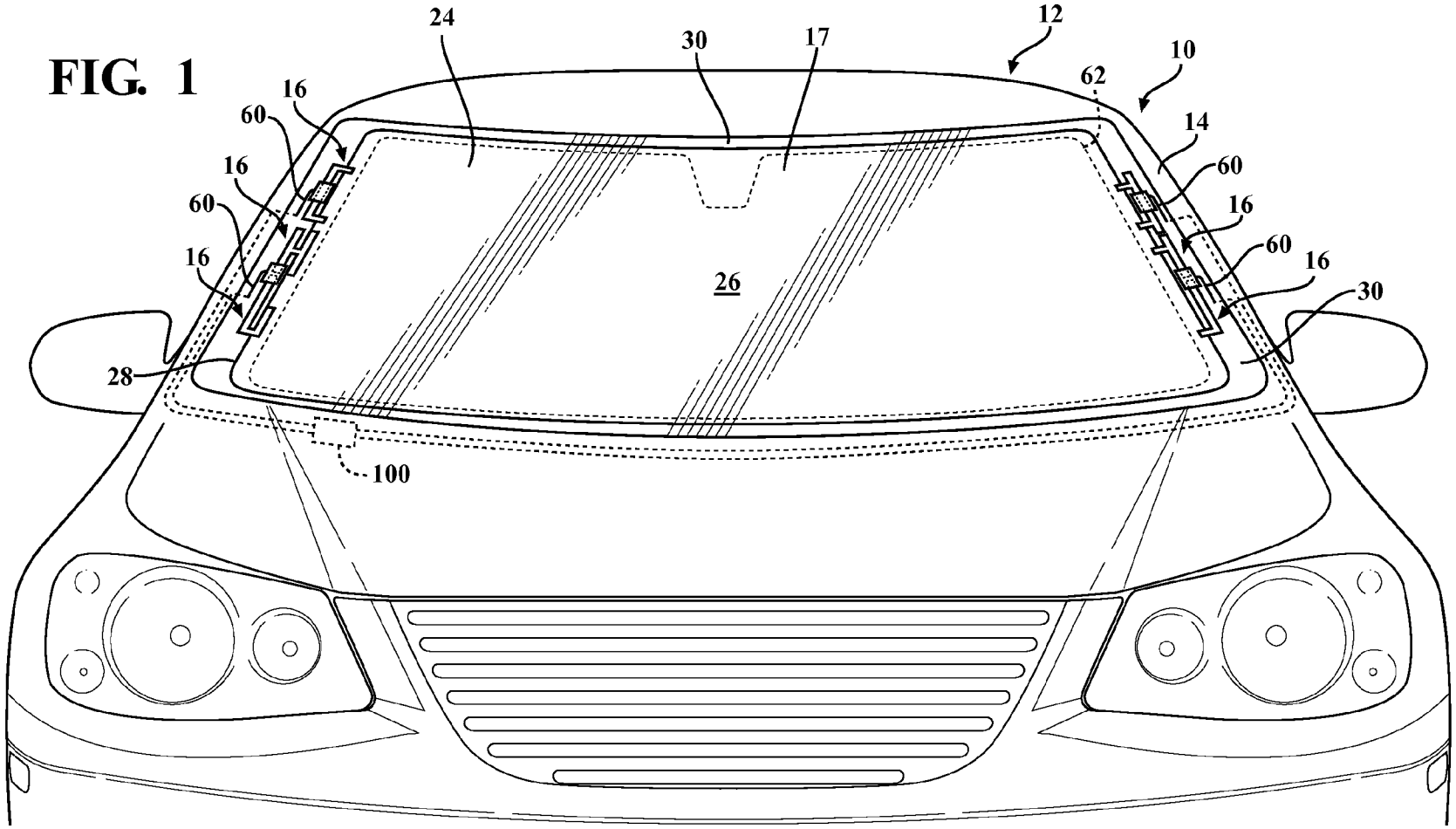
FIG. 1 is a perspective view of a vehicle having a window assembly with a transparent layer and an outer region adjacent the transparent layer with a plurality of antenna elements each having a first antenna segment and a second antenna segment extending from the first antenna segment, according to one embodiment of the present invention.

Referring to the FIGS., wherein like numerals indicate corresponding parts throughout the several views, a window assembly is shown generally at 10 in FIG. 1. In one embodiment, as shown in FIG. 1, the window assembly 10 is for a vehicle 12. The window assembly 10 may be a front window (windshield) as illustrated in FIG. 1. Alternatively, the window assembly 10 may be a rear window (backlite), a roof window (sunroof), or any other window of the vehicle 12. Typically, the vehicle 12 defines an aperture and the window assembly 10 closes the aperture. The aperture is conventionally defined by a window frame 14 of the vehicle 12 which is typically electrically conductive. The window assembly 10 of this invention may be for applications other than for vehicles 12. Specifically, the window assembly 10 may be for architectural applications such as homes, buildings, and the like.

Figure 2:
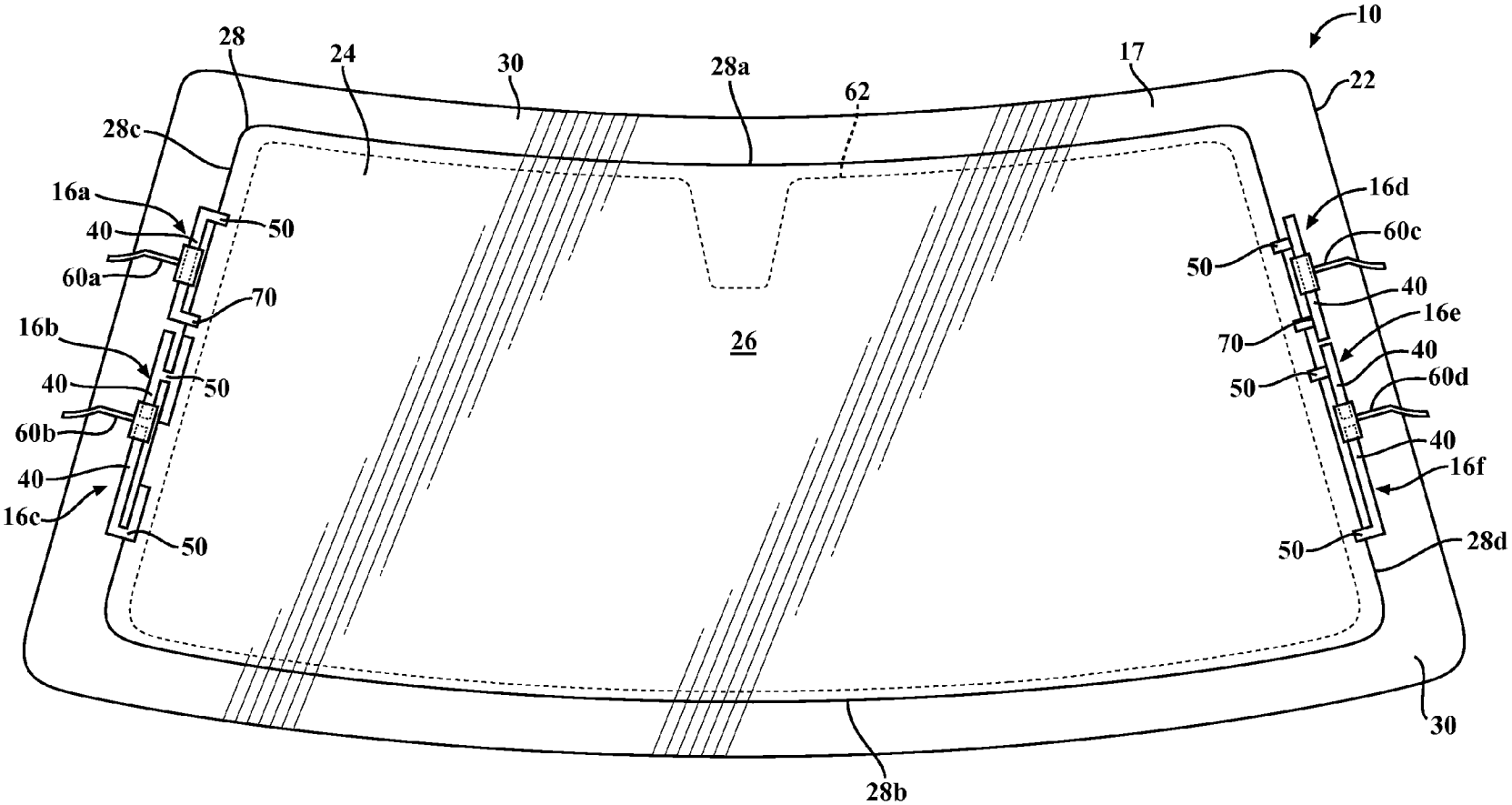
FIG. 2 is a plan view of the window assembly of FIG. 1, according to one embodiment of the present invention.
Figure 4:
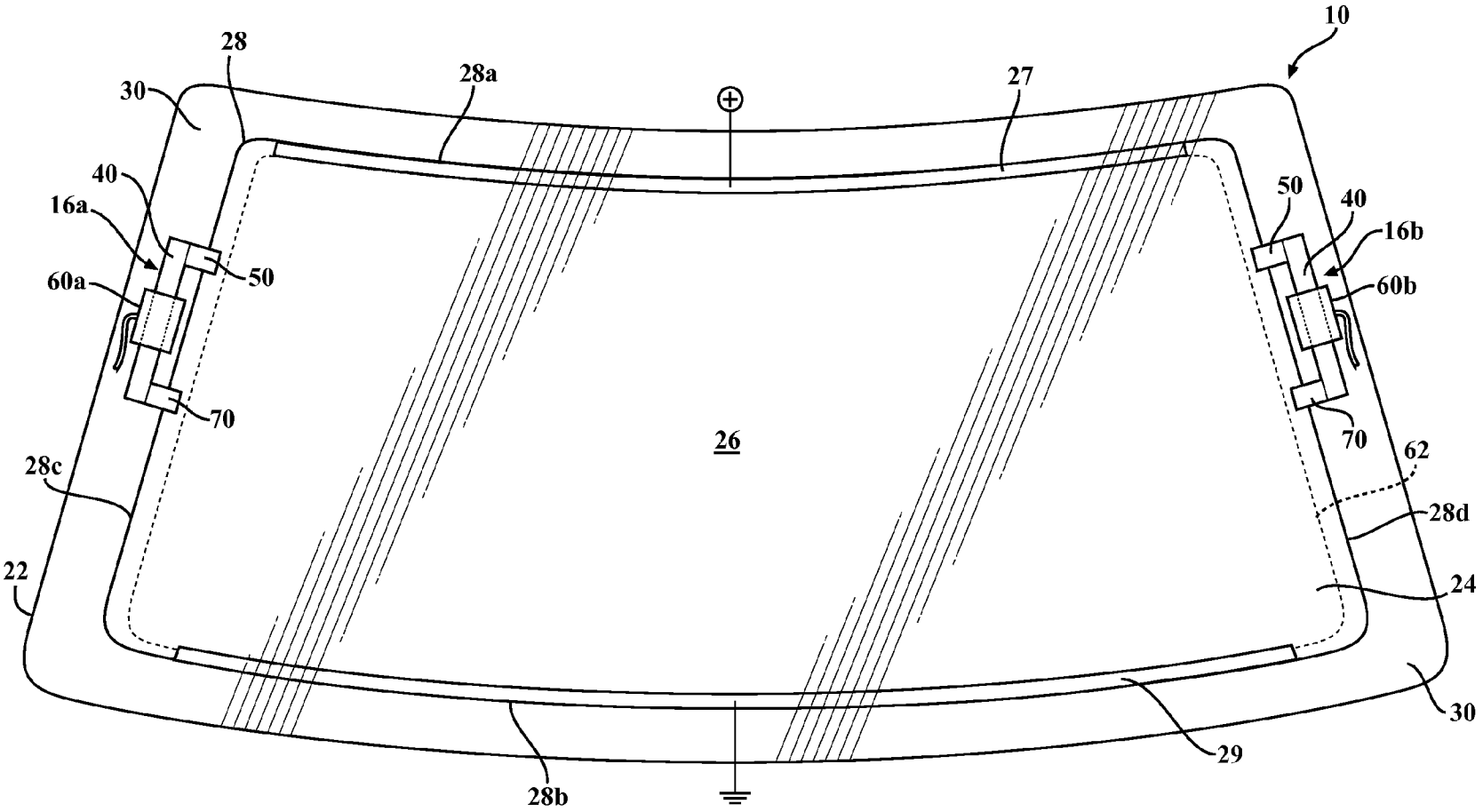
FIG. 4 is a plan view of the window assembly having antenna elements disposed at opposing sides of a periphery of the transparent layer and with the transparent layer being energizable as a defrosting or defogging element, according to one embodiment of the present invention.

As shown throughout the FIGS., the window assembly 10 includes an antenna element 16. In one embodiment, as shown in FIGS. 1, 2 and 4, the window assembly 10 may also include a plurality of antenna elements 16. As will be described in greater detail below, the antenna element 16 transmits and/or receives radio frequency signals.

Figure 3A:
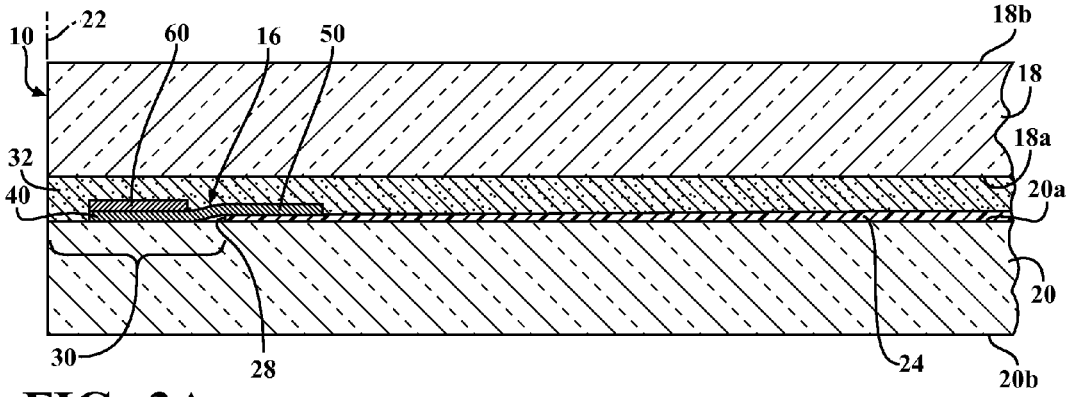
FIG. 3A is a cross-sectional partial view of the window assembly having the transparent layer, the antenna element, and a feeding element sandwiched between an interlayer and an interior substrate of the window assembly, according to one embodiment of the present invention.
Figure 3B:
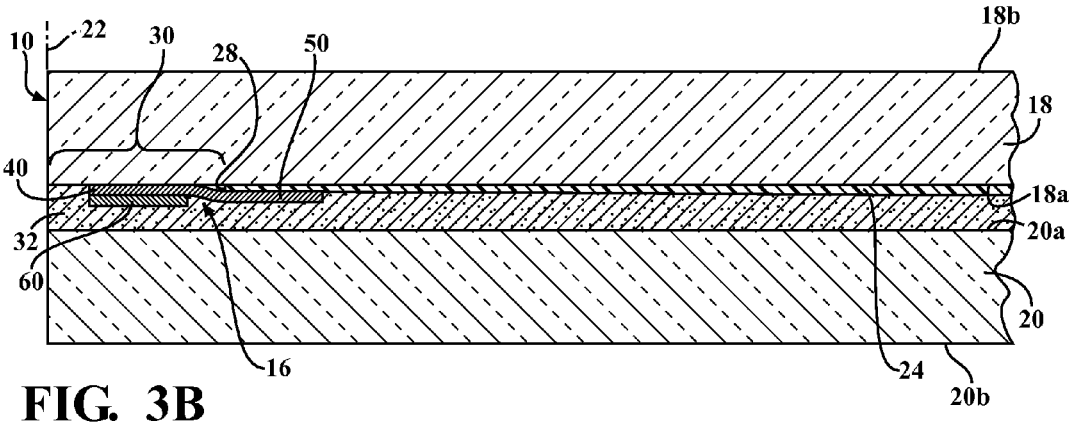
FIG. 3B is a cross-sectional partial view of the window assembly having the transparent layer, the antenna element, and the feeding element sandwiched between the interlayer and an exterior substrate of the window assembly, according to one embodiment of the present invention.
Figure 3C:
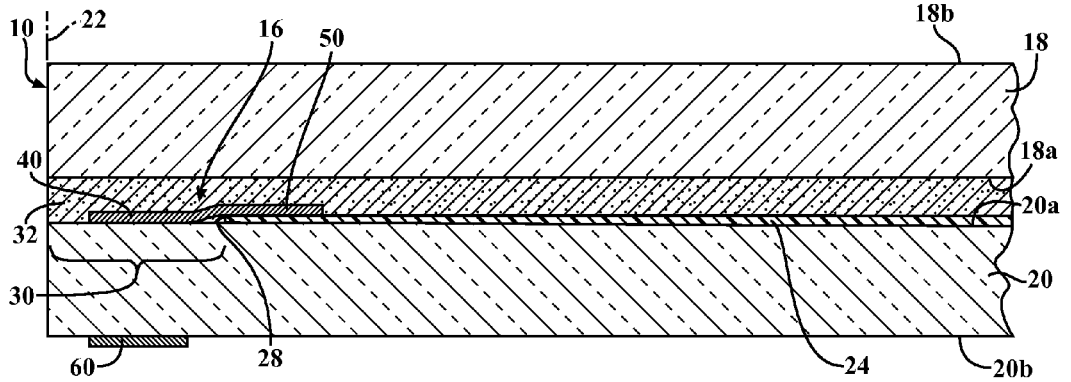
FIG. 3C is a cross-sectional partial view of the window assembly having the transparent layer and the antenna element sandwiched between the exterior and interior substrates with the feeding element disposed on an outer surface of the interior substrate, according to another embodiment of the present invention.

As shown in FIGS. 1 and 2, the window assembly 10 includes a substrate 17. In one embodiment, as shown in FIGS. 3A-3C, the window assembly 10 includes an exterior substrate 18 and an interior substrate 20 disposed adjacent the exterior substrate 18. The substrate 17 may be defined as a single substrate. For example, the substrate 17 may be the exterior substrate 18 or the interior substrate 20. Moreover, the substrate 17 may include a combination of the exterior and interior substrates 18, 20. For simplicity in description, the substrate 17 is described herein by the exterior and interior substrates 18, 20. Although, it is to be appreciated that the substrate 17 may have other configurations not specifically recited herein.

In FIGS. 3A-3C, the exterior substrate 18 is disposed parallel to and spaced from the interior substrate 20 such that the substrates 18, 20 are not contacting one another. Alternatively, the exterior substrate 18 may directly abut the interior substrate 20.

Typically, the exterior and interior substrates 18, 20 are electrically non-conductive. As mentioned herein, the term "non-conductive" refers generally to a material, such as an insulator or dielectric, that when placed between conductors at different electric potentials, permits a negligible current to flow through the material. The exterior and interior substrates 18, 20 are also substantially transparent to light. However, it is to be appreciated that the exterior and interior substrates 18, 20 may be colored or tinted and still be substantially transparent to light. As used herein, the term "substantially transparent" is defined generally as having a visible light transmittance of greater than sixty percent.

The exterior and interior substrates 18, 20 are preferably joined together to form the window assembly 10. In one embodiment, the exterior and interior substrates 18, 20 are panes of glass. The panes of glass are preferably automotive glass and, more preferably, soda-lime-silica glass. However, the exterior and interior substrates 18, 20 may be plastic, fiberglass, or other suitable electrically non-conductive and substantially transparent material. For automotive applications, the exterior and interior substrates 18, 20 are each typically 3.2 mm thick.

In FIGS. 3A-3C, each of the exterior and interior substrates 18, 20 has an inner surface 18*a*, 20*a* and an outer surface 18*b*, 20*b*. In one embodiment, the outer surface 18*b* of the exterior substrate 18 faces an exterior of the vehicle 12 and the outer surface 20*b* of the interior substrate 20 faces an interior of the vehicle 12. The inner surfaces 18*a*, 20*a* of the exterior and interior substrates 18, 20 typically face one another when the exterior and interior substrates 18, 20 are joined together to form the window assembly 10.

As shown in FIGS. 2 and 3, the exterior and interior substrates 18, 20 define a peripheral edge 22 of the window assembly 10. Conventionally, the peripheral edge 22 of the window assembly 10 is shared by the exterior and interior substrates 18, 20, as shown in FIGS. 3A-3C. Specifically, the exterior and interior substrates 18, 20 have substantially similar areas and shapes with each substrate 18, 20 having an edge forming part of the peripheral edge 22 when the substrates 18, 20 are joined. In one embodiment, as shown throughout the FIGS., the peripheral edge 22 has a generally trapezoidal configuration. However, the peripheral edge 22 may have any suitable shape, such as a rectangular configuration, and the like.

As shown throughout the FIGS., a transparent layer 24 is disposed on the substrate 17. In FIGS. 3A-3C, the transparent layer 24 is disposed between the exterior and interior substrates 18, 20. The window assembly 10 may include the transparent layer 24 sandwiched between the exterior and interior substrates 18, 20 such that the transparent layer 24 is abutting the substrates 18, 20. More specifically, the transparent layer 24 may be disposed on one of the inner surfaces 18*a*, 20*a* of the exterior and interior substrates 18, 20. Disposal of the transparent layer 24 between the exterior and interior substrates 18, 20 protects the transparent layer 24 from direct contact with environmental factors which may damage the transparent layer 24 such as snow, ice, and the like. Alternatively, the transparent layer 24 may be disposed on the outer surface 18*b* of the exterior substrate 18 or the outer surface 20*b* of the interior substrate 20.

Typically, the transparent layer 24 is substantially transparent to light. Accordingly, a driver or occupant of the vehicle 12 may see through the window assembly 10 having the transparent layer 24. With the transparent layer 24 disposed within the window assembly 10, the window assembly 10 exhibits generally greater than sixty percent visible light transmission through the window assembly 10. The transparent layer 24 preferably reflects heat from sunlight penetrating the window assembly 10. In particular, the transparent layer 24 reduces transmission of infrared radiation through the window assembly 10.

The transparent layer 24 may include and/or be formed from one or more coatings and/or films of selected composition. The coatings and/or films forming the transparent layer 24 may be single or multiple layers. The transparent layer 24 may be disposed in the window assembly 10 according to any suitable method, such as chemical vapor deposition, magnetron sputter vapor deposition, spray pyrolysis, and the like.

The transparent layer 24 includes a metal compound such that the transparent layer 24 is electrically conductive. As mentioned herein, the term "electrically conductive" refers generally to a material, such as a conductor, exhibiting electrical conductivity for effectively allowing flow of electric current through the material. Conversely, the transparent layer 24 may have any suitable sheet resistance or surface resistance. In one example, the transparent layer 24 has a sheet resistance in a range between 0.5-20 Ω/sq. In another example, the transparent layer 24 has a sheet resistance in a range between 8-12 Ω/sq.

In one embodiment, the metal compound includes a metal oxide. The metal oxide may include a tin oxide, such as indium tin oxide, or the like. The transparent layer 24 may include other metal oxides, including, but not limited to, silver oxide. Alternatively, the metal compound may include a metal nitride, and the like. The metal compound may also be doped with an additive, such as fluorine. Specifically, the additive may be included in the metal compound to optimize the light transmittance and electrical conductivity of the transparent layer 24.

As shown throughout the FIGS., the transparent layer 24 defines an area 26 spanning the window assembly 10. The area 26 may span a majority of the window assembly 10. Specifically, the majority of the window assembly 10 is defined generally as greater than fifty percent of the window assembly 10. More typically, the majority is greater than seventy-five percent of the window assembly 10. The transparent layer 24 may span the majority of the window assembly 10 for maximizing the reduction of transmission of infrared radiation through the window assembly 10. Alternatively, the area 26 of the transparent layer 24 may span a minority of the window assembly 10. For example, the area 26 may span twenty percent of the window assembly 10 along the upper portion of the window assembly 10.

As shown in the FIGS., the area 26 of the transparent layer 24 defines a periphery 28. The periphery 28 of the transparent layer 24 may define any suitable shape. In one embodiment, as shown in FIG. 2, the periphery 28 of the area 26 of the transparent layer 24 defines an upper edge 28*a*, an opposing lower edge 28*b*, and a pair of opposing side edges 28*c*, 28*d* connecting the upper and lower edges 28*a*, 28*b*. In one instance, the periphery 28 defines a shape geometrically similar to the peripheral edge 22 of the window assembly 10. However, the periphery 28 may have any suitable shape for spanning the window assembly 10.

The transparent layer 24 may be energizable as a defrosting or defogging element. For example, as shown in FIG. 4, the window assembly 10 includes a first bus bar 27 and a second bus bar 29 opposite the first bus bar 27. In one embodiment, the first bus bar 27 is disposed along the upper edge 28*a* of the periphery 28 of the transparent layer 24 and the second bus bar 29 is disposed along the lower edge 28*b* of the periphery 28 of the transparent layer 24, or vice-versa. Alternatively, the first bus bar 27 may be disposed along the side edge 28*c* of the periphery 28 of the transparent layer 24 and the second bus bar 29 may be disposed along the opposing side edge 28*d* of the periphery 28 of the transparent layer 24, or vice-versa. The first and second bus bars 27, 29 are in direct electrical contact with the transparent layer 24. In one instance, the first bus bar 27 is connected to a positive terminal of a battery of the vehicle 12 and the second bus bar 27 is connected to the vehicle body and ultimately to a ground terminal of a battery of the vehicle 12. Alternatively, the first bus bar 27 may be connected to ground and the second bus bar 27 may be connected to the positive terminal of a battery of the vehicle 12. Current passes through the transparent layer 24 between the first and second bus bars 27, 29 to energize the transparent layer 24. Ultimately, the electrical current passing through the transparent layer 24 heats the transparent layer 24 such that the transparent layer 24 can effectively defrost or defog. The transparent layer 24 may be energizable as a defrosting or defogging element according to various other methods and configurations.

As shown in embodiments throughout the FIGS., the transparent layer 24 may occupy an entirety of the area 26 such that the transparent layer 24. As such, the area 26 of the transparent layer 24 is free of deletions, slits, or voids that are formed in the area 26 for antenna purposes. Having deletions, slits, or voids in the area 26 of the transparent layer 24 for antenna purposes can be costly and can add complexity to the manufacturing process. In some embodiments, the window assembly 10 advantageously eliminates the need to modify the transparent layer 24 with costly deletions, slits, or voids in the area 26 of the transparent layer 24 for antenna purposes. In other words, in certain embodiments, the window assembly 10 does not rely on deletions, slits, or voids in the area 26 of the transparent layer 24 to modify antenna performance.

A vehicle device, such as a mirror or rain sensor, may be attached or mounted to the window assembly 10. Presence of the transparent layer 24 at a location where the vehicle device attaches to the window assembly 10 may adversely affect performance of the vehicle device. Therefore, the transparent layer 24 may include an opening, typically near the upper edge 28 of the transparent layer 24 to accommodate attachment of the vehicle device on the window assembly 10, as shown in FIGS. 1 and 2. The opening for the vehicle device may extend into the outer region 30, as shown in FIG. 2. In another embodiment, the opening for the vehicle device is surrounded by the transparent layer 24 such that the opening is isolated from and does not extend into the outer region 30. Such an opening for the vehicle device is not regarded as an opening for antenna purposes, such as the above-described slits, voids, and openings, which are for antenna purposes. The opening for the vehicle device may have any suitable shape for accommodating the vehicle device.

As shown in the FIGS., an outer region 30 is defined on the window assembly 10. The outer region 30 is devoid of the transparent layer 24. The outer region 30 is defined adjacent to the transparent layer 24 and along the periphery 28 of the area 26 of the transparent layer 24. In one embodiment, the outer region 30 is defined between the periphery 28 of the transparent layer 24 and the peripheral edge 22 of the window assembly 10.

As shown in FIGS. 1 and 2, the outer region 30 may surround an entirety of the periphery 28 of the area 26 of the transparent layer 24. Having the outer region 30 surround an entirety of the periphery 28 of the transparent layer 24 advantageously provides electrical disconnection between the transparent layer 24 and the window frame 14. Alternatively, the outer region 30 may be defined on predetermined sections of the window assembly 10 such that the outer region 30 is not surrounding the transparent layer 24 continuously along periphery 28 of the transparent layer 24. The outer region 30 is devoid of the transparent layer 24 and is therefore, electrically non-conductive.

The outer region 30 has a width defined generally by a distance between the periphery 28 of the transparent layer 24 and the peripheral edge 22 of the window assembly 10. In one embodiment, the width of the outer region 30 is greater than 0 mm and less than 200 mm. The width of the outer region 30 may vary depending upon how the window assembly 10 is fitted to the window frame 14. For example, the width of the outer region 30 may correspond to an overlap between the window frame 14 and the window assembly 10. The outer region 30 may separate the transparent layer 24 from the window frame 14 to avoid the possibility of an electrical path being established between the transparent layer 24 and the window frame 14, which may adversely affect antenna reception and radiation patterns. Furthermore, the outer region 30 protects the transparent layer 24 by separating the transparent layer 24 from the peripheral edge 22 of the window assembly 10, which is subjected to environmental factors that may degrade the quality of the transparent layer 24.

The outer region 30 may be formed on the window assembly 10 according to any suitable technique known in the art. For instance, the inner surfaces 18*a*, 20*a* of the exterior and/or interior substrates 18, 20 may be masked before application of the transparent layer 24 to provide a desired shape of the outer region 30. Alternatively, the transparent layer 24 may be applied to the window assembly 10 such that the transparent layer 24 is spaced from the peripheral edge 22 of the window assembly 10. Additionally, selected portions of the transparent layer 24 may be removed or deleted to provide the desired shape of the outer region 30. Removal or deletion of selected portions of the transparent layer 24 may be accomplished using lasers, abrasive tools, chemical removal, and the like.

Although not required, an interlayer 32 may be disposed between the inner surfaces 18*a*, 20*a* of the exterior and interior substrates 18, 20, as illustrated in FIGS. 3A-3C. The window assembly 10 may include the exterior and interior substrates 18, 20 having the transparent layer 24 and the interlayer 32 sandwiched therebetween. The interlayer 32 bonds the exterior and interior substrates 18, 20 and prevents the window assembly 10 from shattering upon impact. The interlayer 32 is substantially transparent to light and typically includes a polymer or thermoplastic resin, such as polyvinyl butyral (PVB). Other suitable materials for implementing the interlayer 32 may be used. In one embodiment, the interlayer 32 has a thickness of between 0.5 mm to 1 mm.

The transparent layer 24 may be disposed adjacent the interlayer 32. In one embodiment, the transparent layer 24 is disposed between the interlayer 32 and the inner surface 18*a* of the exterior substrate 18, as shown in FIG. 3B. Alternatively, as shown in FIGS. 3A and 3C, the transparent layer 24 is disposed between the interlayer 32 and the inner surface 20*a* of the interior substrate 20. In FIGS. 3A-3C, the transparent layer 24 and interlayer 32 are sandwiched between the exterior and interior substrates 18, 20 such that the interlayer 32 and the transparent layer 24 are abutting the inner surfaces 18*a*, 20*a* of the exterior and/or interior substrates 18, 20.

As referenced above, the window assembly 10 includes the antenna element 16. As shown throughout the FIGS., the antenna element 16 is disposed on the substrate 17. In one embodiment, the antenna element 16 is disposed between the exterior and interior substrates 18, 20. In another embodiment, the antenna element 16 is disposed between the interlayer 32 and the inner surface 18*a* of the exterior substrate 18, as shown in FIG. 3B. Alternatively, as shown in FIGS. 3A and 3C, the antenna element 16 is disposed between the interlayer 32 and the inner surface 20*a* of the interior substrate 20. Between the exterior and interior substrates 18, 20, the antenna element 16 may be disposed coplanar with the transparent layer 24.

Additionally, the antenna element 16 may be disposed on the outer surface 18*b* of the exterior substrate 18 or the outer surface 20*b* of the interior substrate 20.

The antenna element 16 may be disposed non-coplanar with the transparent layer 24. In one example, as shown in FIGS. 3A-3C, the antenna element 16 is non-coplanar with the transparent layer 24 in the area 26 of the transparent layer 24 but coplanar with the transparent layer 24 in the outer region 30.

As shown in the FIGS., the antenna element 16 is disposed within the peripheral edge 22 of the window assembly 10 such that antenna element 16 does not physically extend beyond the peripheral edge 22 of the window assembly 10.

The antenna element 16 is electrically conductive. The antenna element 16 may be formed of any suitable conductor. The antenna element 16 may be applied to the window assembly 10 according to any suitable method, such as printing, firing, adhesion and the like. In one example, the antenna element 16 comprises an electrically conductive paste, such as a silver paste. In another example, the antenna element 16 comprises a conductive adhesive, such as a copper tape. In yet another example, the antenna element 16 comprises metal wire. The antenna element 16 generally includes a substantially flat configuration. As such, the antenna element 16 may be suitably disposed between the exterior and interior substrates 18, 20. In one embodiment, the antenna element 16 is substantially opaque to light such that light cannot pass through the antenna element 16. Moreover, the first and second antenna segments 40, 50 may be applied to the window assembly 10 without any modification to the area 28 of the transparent layer 24.

As shown throughout the FIGS., the antenna element 16 includes a first antenna segment 40. The first antenna segment 40 is elongated. The first antenna segment 40 has a first end 42 and a second end 44 opposite the first end 42. In one embodiment, the first antenna segment 40 has a rectangular configuration with a pair of short sides and a pair of connecting elongated sides. In such embodiments, the first and second ends 42, 44 of the first antenna segment 40 are generally defined at the short sides of the rectangular configuration.

Figure 5:
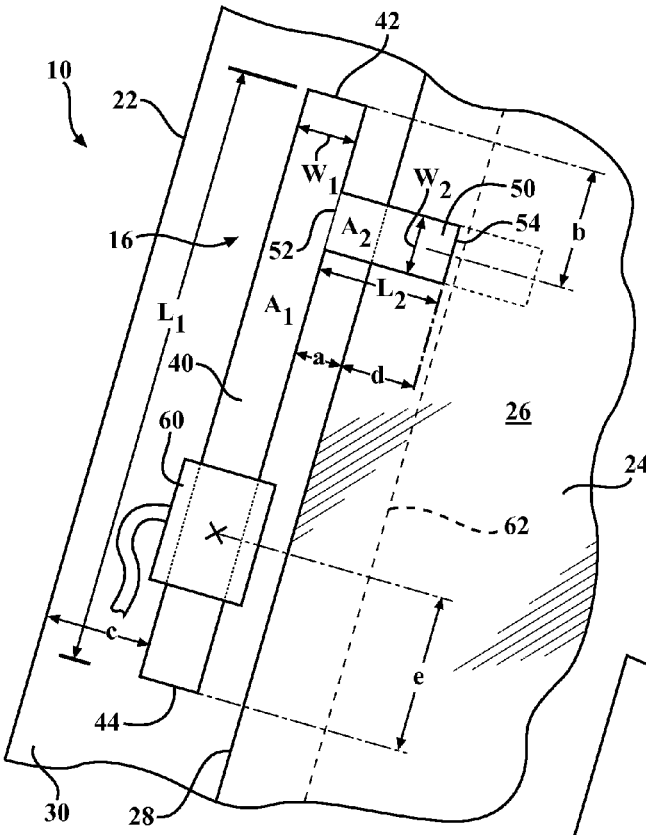
FIG. 5 is a plan view of the antenna element having the first and second antenna segments, according to one embodiment of the present invention.
Figure 6:
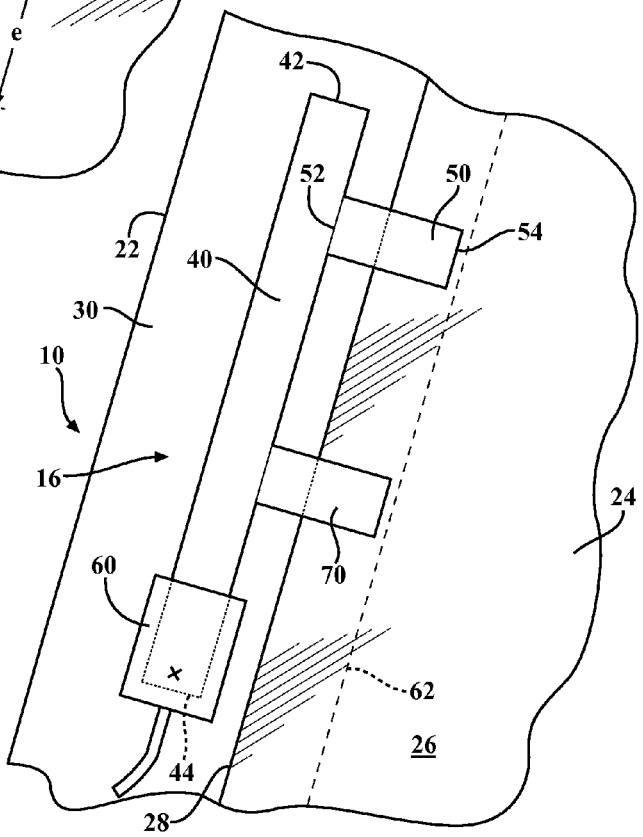
FIG. 6 is a plan view of the antenna element having the first and second antenna segments and a third antenna segment extending from the first antenna segment, according to one embodiment of the present invention.

As shown in FIGS. 5, the first antenna segment 40 may also have an area A1 defined by a length "L1" and a width "W1." In one embodiment, the width W1 of the first antenna segment 40 is substantially consistent along the length L1 of the first antenna segment 40. Alternatively, the width W1 of the first antenna segment 40 may vary along the length L1 of the first antenna segment 50.

The length L1 of the first antenna segment 40 may be any suitable dimension. In one embodiment, the length L1 of the first antenna segment 40 is in a range between 5-25 cm. In another embodiment, the length L1 of the first antenna segment 40 is in a range between 10-15 cm. In one specific embodiment the length L1 of the first antenna segment 40 is 13 cm or 25 cm.

Additionally, the Width W1 of the first antenna segment 40 may be any suitable dimension. In one embodiment, the width W1 of the first antenna segment 40 is in a range between 0.2-1 cm. In another embodiment, the width W1 of the first antenna segment 40 is approximately 0.5 cm. The first antenna segment 40 may have other configurations and dimensions without departing from the scope of the invention.

The first antenna segment 40 is disposed in the outer region 30. In the outer region 30, the first antenna segment 40 is spaced from the periphery 28 of the transparent layer 24. In other words, the first antenna segment 40 does not directly contact the transparent layer 24.

The first antenna segment 40 extends along the periphery 28 of the transparent layer 24. Having the first antenna segment 40 extend along the periphery 28 is important for improving antenna impedance matching and radiation pattern altering, as will be described in greater detail below. In one embodiment, as shown throughout the FIGS., the first antenna segment 40 extends substantially parallel to the periphery 28. In instances where the first antenna segment 40 has a rectangular configuration, the elongated side of the first antenna segment 40 may extend parallel to the periphery 28. Having the first antenna segment 40 extend substantially parallel to the periphery 28 maximizes antenna impedance matching and radiation pattern altering effects by the first antenna segment 40. Alternatively, the first antenna segment 40 extends along the periphery 28 at a predetermined angle. The predetermined angle is defined generally between the periphery 28 and an edge of the first antenna segment 40 adjacent the periphery 28. In one instance, the predetermined angle is approximately 15 degrees. In some instances, the first end 42 of the first antenna segment 40 may be disposed nearer to the periphery 28 than the second end 44 of the first antenna segment 40. Alternatively, the first end 42 of the first antenna segment 40 may be disposed further from the periphery 28 than the second end 44 of the first antenna segment 40.

In another embodiment, as shown in FIGS. 11 and 12, the first antenna segment 40 extends partially along one of the side edges 28*c*, 28*d* of the periphery 28 and partially along one of the upper and lower edges 28*a*, 28*b* of the periphery 28. For example, the periphery 28 of the transparent layer 24 defines a corner where one of the side edges 28*c*, 28*d* of the periphery 28 connects to one of the upper and lower edges 28*a*, 28*b* of the periphery 28. The first antenna segment 40 extends along the corner of the periphery 28. In such embodiments, the first antenna segment 40 may bend or curve in the outer region 30 such that the first antenna segment 40 maintains position along the periphery 28 of the transparent layer 24.

The antenna element 16 includes a second antenna segment 50. The second antenna segment 50 extends from the first antenna segment 40 toward the transparent layer 24. In doing so, the second antenna segment 50 crosses the periphery 28 of the transparent layer 24. In one embodiment, the second antenna segment 50 is disposed partially in the outer region 30 and disposed partially in the area 26 of the transparent layer 24. Any suitable portion of the second antenna segment 50 may be disposed in the transparent layer 24 or the outer region 30. For instance, one portion of the second antenna segment 50 representing eighty percent of the antenna element 16 may be disposed the outer region 30 while the remaining portion representing twenty percent of second antenna segment 50 may be disposed in the transparent layer 24, or vice-versa.

As shown in FIGS. 5-18, the second antenna segment 50 has a first end 52 and a second end 54 opposite the first end 52. The first end 52 of the second antenna segment 50 connects to the first antenna segment 40.

The second antenna segment 50 abuts and is in direct electrical contact with the transparent layer 24. The second antenna segment 50 is directly adjacent to the transparent layer 24 such that the second antenna segment 50 and the transparent layer 24 are in a directly contacting state. At least a portion of the second antenna segment 50 is disposed directly on the transparent layer 24. In one instance, the second end 54 of the second antenna segment 50 connects to the transparent layer 24.

The second antenna segment 50 may abut the transparent layer 24 according to various configurations. In one embodiment, as shown in FIGS. 3A-3C, the second antenna segment 50 may be disposed directly on the transparent layer 24. In FIGS. 3A-3C, the second antenna segment 50 is disposed non-coplanar with the transparent layer 24. Alternatively, the second antenna segment 50 may be disposed coplanar with the transparent layer 24.

By abutting the transparent layer 24, the second antenna segment 50 advantageously provides a DC connection between the first antenna segment 40 and the transparent layer 24. In providing the DC connection, the second antenna segment 50 allows a footprint of the antenna element 16 to be substantially minimized. Specifically, the areas A1/A2 of the first and second antenna segments 40, 50 may be minimized.

In one embodiment, as shown in the FIGS., the second antenna segment 50 extends substantially perpendicular from the first antenna segment 40. In FIGS. 5-7, 10, 14, 16-18, the second antenna segment 50 extends from the first antenna segment 40 between the first and second ends 42, 44 of the first antenna segment 40. In such instances, the second antenna segment 50 is spaced from each one of the first and second ends 42, 44 of the first antenna segment 50. In FIGS. 4, 8, 11-13, and 15 the second antenna segment 50 extends from the first antenna segment 40 at one of the first and second ends 42, 44 of the first antenna segment 50. In such instances, the first and second elements 40, 50 have an L-shaped configuration.

In one embodiment, the second antenna segment 50 has a rectangular configuration with a pair of short sides and a pair of connecting elongated sides. In such embodiments, the first and second ends 52, 54 of the second antenna segment 50 are generally defined at the short sides of the rectangular configuration. The second antenna segment 50 may have other configurations, such as a square configuration.

As shown in FIG. 5, the second antenna segment 50 may also define an area A2 having a length "L2 " and a width "W2." In one embodiment, the width W2 of the second antenna segment 50 is substantially consistent along the length L2 of the second antenna segment 50. Alternatively, the width W2 of the second antenna segment 50 may vary along the length L2 of the second antenna segment 50.

The length L2 of the second antenna segment 50 may be any suitable dimension. In one embodiment, the length L2 of the second antenna segment 50 is in a range between 0.5-10 cm. In another embodiment, the length L2 of the second antenna segment 50 is approximately 1-2 cm.

The width W2 of the second antenna segment 50 may be any suitable dimension. In one embodiment, the width W2 of the second antenna segment 50 is in a range between 0.2-1 cm. In another embodiment, the width W2 of the second antenna segment 50 is approximately 0.5 cm. The second antenna segment 50 may have other configurations without departing from the scope of the invention.

The first and second antenna segments 40, 50 may be defined according to various configurations with respect to one another. In one example, the length L1 of the first antenna segment 40 is longer than the length L2 of the second antenna segment 50. Alternatively, the length L1 of the first antenna segment 40 may be shorter than the length L2 of the second antenna segment 50. Moreover, the length L1 of the first antenna segment 40 may be equal to the length L2 of the second antenna segment 50. In another example, the width W1 of the first antenna segment 40 is wider than the width W2 of the second antenna segment 50. Alternatively, the width W1 of the first antenna segment 40 is narrower than the width W2 of the second antenna segment 50. Furthermore, the width W1 of the first antenna segment 40 may be equal to the width W2 of the second antenna segment 50. In other embodiments, the area A1 of the first antenna segment 40 may be greater than the area A2 of the second antenna segment 50. The area A1 of the first antenna segment 40 may be less than the area A2 of the second antenna segment 50. Moreover, the area A1 of the first antenna segment 40 may be equal to the area A2 of the second antenna segment 50.

In one embodiment, the first and second antenna segments 40, 50 are integrally formed such that the second antenna segment 50 extends integrally from the first antenna segment 40. Alternatively, the first and second antenna segments 40, 50 are formed separately such that the second antenna segment 50 extends non-integrally from the first antenna segment 40.

The first and second antenna segments 40, 50 are configured to transmit and/or receive radio signals. Furthermore, the first and second antenna segments 40, 50 play an important role in optimizing antenna performance of the window assembly 10. For example, the first and second antenna segments 40, 50 operate to alter radiation patterns and provide impedance matching. In one embodiment, the first and second antenna segments 40, 50 both operate to alter radiation patterns and provide impedance matching. In another embodiment, the first antenna segment 40 has an emphasized role in operating to alter radiation patterns while the second antenna segment 50 has an emphasized role in providing impedance matching, or vice-versa.

The first and second antenna segments 40, 50 operate to provide impedance matching by matching impedance of the first antenna segment 40, the second antenna 50, and the transparent layer 24 to an impedance of a cable or circuit. The cable, for example, may be a cable, such as a coaxial cable, that is connected to a feeding element that energizes the first antenna segment 40, the second antenna 50, and the transparent layer 24, as will be described below. The circuit, for example, may be an amplifier or other circuits that are connected to the first antenna segment 40, the second antenna 50, and the transparent layer 24 through either a cable or lead wire.

The first and second antenna segments 40, 50 operate to alter radiation patterns by altering directions by which radio signals are transmitted and/or received by the first antenna segment 40, the second antenna 50, and/or the transparent layer 24. More specifically, the first and/or second antenna segments 40, 50 may alter directions by which radio signal are transmitted and/or received such that the radiation pattern (s) exhibit greater omni-directionality. By doing so, the first and second antenna segments 40, 50 provide greater control over radiation patterns. The first and second antenna segments 40, 50 further help to counteract electromagnetic interference to ensure optimal reception. As such, the first and second antenna segments 40, 50 enhance antenna performance.

At higher frequencies, the first antenna segment 40 has an emphasized role in radiation pattern alternation. At lower frequencies, the first antenna segment 40 has an emphasized role in impedance matching.

Antenna performance is further fine-tuned based upon the strategic and dimensioning of the first and second antenna segments 40, 50 and positioning of such in relation to the transparent layer 24 and each other. For instance, the length L1/L2, width W1/W2, and/or area A1/A2 of the first and second antenna segments 40, 50 each have a significant impact on antenna performance. As shown in FIG. 5, other examples of strategic positing and dimensioning of the first and second antenna segments 40, 50 include (i) a distance "a" between the first antenna segment 40 and the periphery 28 of the transparent layer 24, (ii) a distance "b" between the second antenna segment 50 and the first and/or second ends 42, 44 of the first antenna segment 40, (iii) a distance "c" between the first antenna segment 40 and the peripheral edge 22 of the window assembly 10, and (iv) a distance "d" between the second end 54 of the second antenna segment 50 and the periphery 28 of the transparent layer 24.

The first and second antenna segments 40, 50 and the transparent layer 24 each have an electrical conductivity. In one embodiment, the electrical conductivity of each of the first and second antenna segments 40, 50 is of a higher order of magnitude than the electrical conductivity of the transparent layer 24. By having the electrical conductivity configured as such, more electrical current concentrates in the first and second antenna segments 40, 50 than the transparent layer 24. This allows for greater impact on impedance matching and radiation pattern alteration while allowing a reduction in the footprint of the antenna element 16. In another embodiment, the electrical conductivity of one of the first and second antenna segments 40, 50 is of a higher order of magnitude than the electrical conductivity than the other one of the first and second antenna segments 40, 50.

As shown throughout the FIGS., the window assembly 10 includes a feeding element 60. The feeding element 60 is coupled to the antenna element 16. As shown in the FIGS., the feeding element 60 is coupled to the first antenna segment 40. In FIGS. 5, 9-11, and 15-18 the feeding element 60 is coupled between the first and second ends 42, 44 of the first antenna segment 40. In such configurations, the feeding element 60 is spaced from each one of the first and second ends 42, 44 of the first antenna segment 40. Alternatively, as shown in FIGS. 6-8, and 12-14 the feeding element 60 is coupled to the first antenna segment 40 at one of the first and second ends 42, 44 of the first antenna segment 40. In other embodiments, the feeding element 60 couples to the second antenna segment 50. The feeding element 60 may be positioned with respect to the antenna element 16 according to various other configurations.

The feeding element 60 is disposed on the window assembly 10 according to various configurations. As shown in the FIGS., the feeding element 60 is disposed in the outer region 60. In such instances, the feeding element 60 is spaced from the transparent layer 24 such that feeding element 60 does not directly abut the transparent layer 24. The feeding element 60 may be disposed entirely within the outer region 30. Alternatively, part of the feeding element 60 may be disposed in the outer region 30. Furthermore, the feeding element 60 may be disposed beyond the outer region 30. For instance, the feeding element 60 may partially extend beyond the peripheral edge 22 of the window assembly 10, as shown in FIG. 2. This allows the feeding element 60 to be easily connected to corresponding electrical systems or the vehicle 12 during manufacturing. Having the antenna element 16 disposed along the periphery 28 of the transparent layer 24 allows for simplified feeding arrangements because the feeding element 60 generally must connect to antenna element 16 from the peripheral edge 22 of the window assembly 10.

The feeding element 60 may be disposed on the substrate 17. The feeding element 60 may be disposed adjacent and in planar relationship to the antenna element 16 and the transparent layer 24. The feeding element 60 may be disposed coplanar or non-coplanar with respect to the antenna element 16. As shown in FIG. 3A, the feeding element 60 is disposed between the interlayer 32 and the inner surface 20*a* of the interior substrate 20. Alternatively, as shown in FIG. 3B, the feeding element 60 is disposed between the interlayer 32 and the inner surface 18*a* of the exterior substrate 18. The feeding element 60 may also be disposed on the outer surface 18*b*, 20*b* of one of the exterior and interior substrates 18, 20, as shown in FIG. 3C.

According to one embodiment, as shown in FIGS. 3A and 3B, the feeding element 60 is abutting and in direct electrical connection with the antenna element 16. The feeding element 60 passes electrical current to the antenna element 16 directly through an electrically conductive material, such as a feeding strip or wire, physically attached to the antenna element 16. For example, the feeding element 60 may be directly wired or soldered to the antenna element 16. In one embodiment, the feeding element 60 is non-coplanar with the antenna element 16 and directly connected atop the first antenna segment 40. In another embodiment, the feeding element 60 coplanar with the antenna element 16 and directly connected to one of the first and second ends 42, 44 of the first antenna segment 40. The feeding element 60 and the antenna element 16 may be abutting and in direct electrical connection on the window assembly 10 according to several other configurations with respect to the transparent layer 24 and the interlayer 32 not specifically illustrated throughout the FIGS.

Alternatively, as shown in FIG. 3C, the feeding element 60 may be spaced from and capacitively coupled to the antenna element 16. In such instances, the feeding element 60 induces electrical current to the antenna element 16 through the air or a dielectric material, such as the exterior or interior substrates 18, 20 and/or interlayer 32. When capacitively coupled, the feeding element 60 is neither hard-wired nor in direct contact with the antenna element 16 and is generally disposed non-coplanar with the antenna element 16. In one embodiment, as shown in FIG. 3C, the feeding element 60 is disposed on the outer surface 20*b* of the interior substrate 20 and capacitively coupled to the antenna element 16 disposed between the interlayer 32 and the inner surface 20*a* of the interior substrate 20. The feeding element 60 may be spaced from and capacitively coupled to the antenna element 16 on the window assembly 10 according to several other embodiments with respect to the transparent layer 24 and the interlayer 32 which are not specifically illustrated throughout the FIGS.

The feeding element 60 is configured to energize the first and second antenna segments 40, 50 and the transparent layer 24 such that first and second antenna segments 40, 50 and the transparent layer 24 collectively transmit and/or receive radio frequency signals. In one embodiment, the feeding element 60 jointly energizes the antenna element 16 and the transparent layer 24. The feeding element 60 is electrically coupled to the antenna element 16 and the transparent layer 24 such that the antenna element 16 and the transparent layer 24 operate as active antenna elements for excitation or reception of radio frequency waves.

With respect to the feeding element 60, the term "energize" is understood to describe an electrical relationship between the feeding element 60 and the antenna element 16 and transparent layer 24 whereby the feeding element 60 excites the antenna element 16 and transparent layer 24 for transmission of radio waves, and is electrically coupled to the antenna element 16 and transparent layer 24 for reception of impinging radio waves.

The feeding element 60 may include any suitable material for energizing the antenna element 16. As shown throughout the FIGS., the feeding element 60 may couple to the antenna element 16 at a feed point, identified as an "X" throughout the FIGS. The feed point may be disposed at various locations with respect to the feeding element 60. In one embodiment, the feeding element 60 includes a coaxial line having a center conductor coupled to the antenna element 16 at the feed point "X" and a ground conductor grounded to the window frame 14. In other embodiments, the feeding element 60 includes a feeding strip, a feeding wire, or a combination of both. Also, the feeding element 60 may be a balanced or unbalanced line. For example, the feeding element 60 may be an unbalanced coaxial cable, microstrip, or single wire line. Furthermore, the feeding element 60 may include any suitable feeding network for providing phase shifting to the radio frequency signal transmitted or received by the antenna element 16. In one embodiment, the feeding element 60 couples to the antenna element 16 at a plurality of feed points, as shown in FIG. 9.

In one embodiment, the first and second antenna segments 40, 50 and the transparent layer 24 collectively transmit and/or receive linearly polarized radio frequency signals. In one example, the first and second antenna segments 40, 50 and the transparent layer 24 may collectively transmit and/or receive radio frequency signals for at least one of Remote Keyless Entry (RKE), Digital Audio Broadcasting (DAB), FM, cellular and TV applications.

Antenna performance is further fine-tuned based upon the strategic dimensioning of the feeding element 60 and positioning of such in relation to the first and second antenna segments 40, 50 and/or the transparent layer 24. As shown in FIG. 5, one example of such strategic positing and dimensioning of the feeding element 60 includes a distance "e" between the feed point "X" of the feeding element 60 and the first and/or second ends 42, 44 of the first antenna segment 40.

In one embodiment, the feeding element 60 and the antenna element 16 may be integrated into a single component. The single component including the feeding element 60 and the antenna element 16 may be readily removed and attached to the window assembly 10. In one example, the single component includes conductors and/or traces embedded within an electrically isolating member. The single component may have a substantially flat configuration such that the single component may be easily sandwiched between the interior and exterior substrates 18, 20. The single component may include a mating connector for connecting to the corresponding electrical system, such as the electrical system of the vehicle 12, and the like.

The outer region 30 may have any suitable dimensions, configuration, or shape for accommodating the antenna element 16 and/or feeding element 60. For instance, the outer region 30 may have a rectangular configuration, a curved configuration, or the like. More specifically, outer region 30 may follow a substantially linear path, curved path, or the like. The outer region 30 may be sized such that the antenna element 16 and/or the feeding element 60 substantially occupy the outer region 30. In other words, the outer region 30 may be sized to the extent necessary to effectively accommodate the antenna element 16 and/or feeding element 60. As such, the area 26 of the transparent layer 24 is maximized for its other functions, such as an antenna radiating element or an element for reflecting infrared radiation penetrating the window assembly 10. Alternatively, the antenna element 16 and/or feeding element 60 may occupy only a minority of the outer region 30. Disposal of the antenna element 16 and/or feeding element 60 in the outer region 30 provides an unobstructed field of view for the driver of the vehicle 12.

In one embodiment, the antenna element 16 and the feeding element 60 are positioned such that the antenna element 16 and the feeding element 60 cause minimal obstruction to the vision of an occupant of the vehicle 12. As mentioned above, in many embodiments, the antenna element 16 and the feeding element 60 are disposed substantially in the outer region 30 such that the antenna element 16 and the feeding element 60 do not obstruct the vision of the occupant. Moreover, as shown throughout the FIGS., the window assembly 10 may include an opaque layer 62 that is applied to one of the interior and exterior substrates 18, 20. The opaque layer 62 conceals the antenna element 16 and the feeding element 60 for an aesthetically appealing configuration. As shown in the FIGS., the opaque layer 62 extends from the peripheral edge 22 of the window assembly 10 toward the transparent layer 24.

Specifically, the opaque layer 62 extends past the periphery 28 of the transparent layer 24. By doing so, the opaque layer 62 conceals the second antenna segment 50 that extends into the transparent layer 24 thereby completely concealing the antenna element 16. In one embodiment, the opaque layer 62 is formed of a ceramic print 62.

The window assembly 10 may include a plurality of antenna elements 16 and/or a plurality of feeding elements 60. In one embodiment, as shown in FIGS. 7-12, a single feeding element 60 is coupled to a single antenna element 16. Such configurations may be defined as a single-port configuration. In one embodiment, as shown in FIG. 9, the single feeding element 60 may connect to the antenna element 16 at a plurality of feed points. In such configurations, the feeding element 60 may include a conductor 64 coupled to each feed point. The conductors 64 may be connected, or spliced together, such that only a single conductor 64 is required to enter the feeding element 60 for energizing the antenna element 16 at the plurality of feed points.

Figure 13:
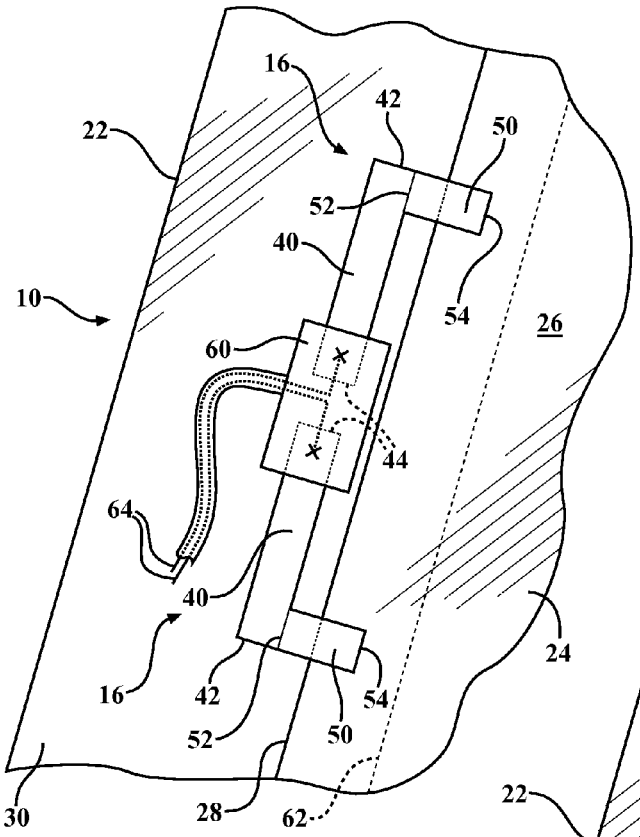
FIG. 13 is a plan view of a single feeding element coupled to two antenna elements, according to one embodiment of the present invention.
Figure 14:
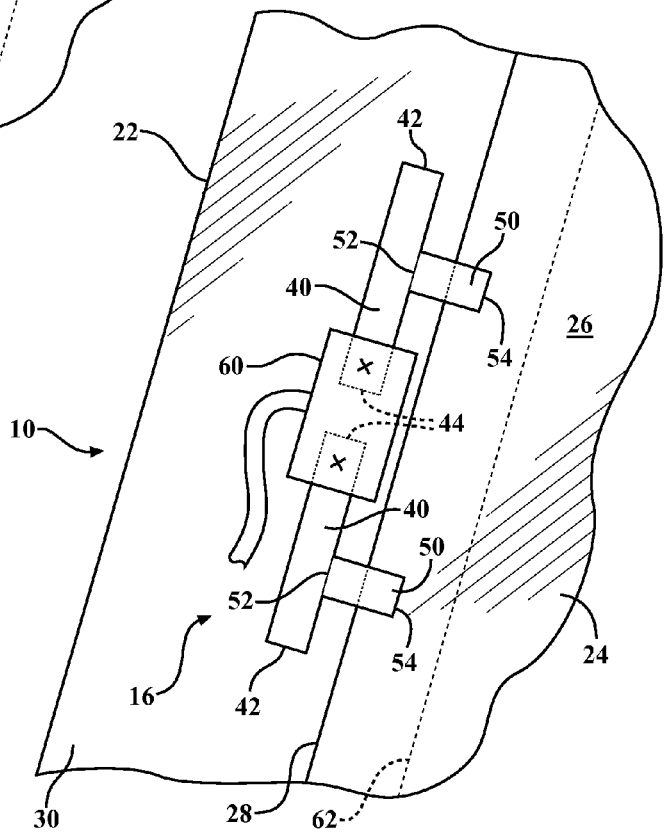
FIG. 14 is a plan view of the single feeding element coupled to two antenna elements, according to another embodiment of the present invention.

In another embodiment, as shown in FIGS. 13 and 14, a single feeding element 60 is coupled to a plurality of antenna elements 16. Such configurations may be defined as a multi-port configuration. In FIGS. 13 and 14, the window assembly 10 includes two antenna elements 16 and a single feeding element 60 coupled to both of the antenna elements 16. In FIGS. 13 and 14, the feeding element 60 connects to each of the antenna elements 16 at a separate feed point. In such configurations, the single feeding element 60 may include separate conductors 64 each coupled to each separate antenna element 16. In such instances, the feeding element 60 effectively operates as two separate feeding elements 60 consolidated into a single feeding unit. In one example, the feeding element 60 couples to one of the first and second ends 42, 44 of the first antenna segment 40 of each one of the two antenna elements 16. The feeding element 60 may couple to various other parts of the antenna element(s) 16.

As shown in FIGS. 4, 6, 9, 10, 12, 17 and 18, the antenna element 16 may have a third antenna segment 70. The third antenna segment 70 extends from the first antenna segment 40 to the transparent layer 24. The third antenna segment 70 crosses the periphery 28 of the transparent layer 24. The third antenna segment 70 abuts and is in direct electrical contact with the transparent layer 24.

The addition of the third antenna segment 70 generally provides greater flexibility to improve impedance of the window assembly 10 as compared with simpler configurations. As such, the window assembly 10 including the third antenna segment 70 generally exhibits an even wider transmission or reception bandwidth as compared with the window assembly 10 having the antenna element 16 having only the first and second segment 40, 50.

In one example, the third antenna segment 70 extends perpendicularly from the first antenna segment 40 to the transparent layer 24. In FIGS. 6, 10, 12, 17 and 18, the third antenna segment 70 extends from the first antenna segment 40 between the first and second ends 42, 44 of the first antenna segment 40. In such configurations, the third antenna segment 70 is spaced from each one of the first and second ends 42, 44 of the first antenna segment 40. In FIGS. 4 and 9, the third antenna segment 70 extends from the first antenna segment 40 at one of the first and second ends 42, 44 of the first antenna segment 40. In yet another embodiment, in FIGS. 4 and 9, the second antenna segment 50 extends from the first antenna segment 40 at one of the first and second ends 42, 44 of the first antenna segment 40 and the third antenna segment 70 extends from the first antenna segment 40 at the other one of the first and second ends 42, 44 of the first antenna segment 40. In such configurations, the first, second, and third antenna segments 40, 50, 70 have a substantially C-shaped configuration. The third antenna segment 70 may extend according to other configurations without departing form the scope of the invention.

Many of the physical, mechanical, positional, dimensional, and functional properties and advantages of the second antenna segment 50 may correspond to the third antenna segment 50. Thus, for simplicity in description, those properties of the second antenna segment 50 described herein may be referenced to describe the third antenna segment 70. Of course, it is to be appreciated that the second and third antenna segments 50 are not necessarily identical and may exhibit different properties and provide unique advantages.

Figure 15:
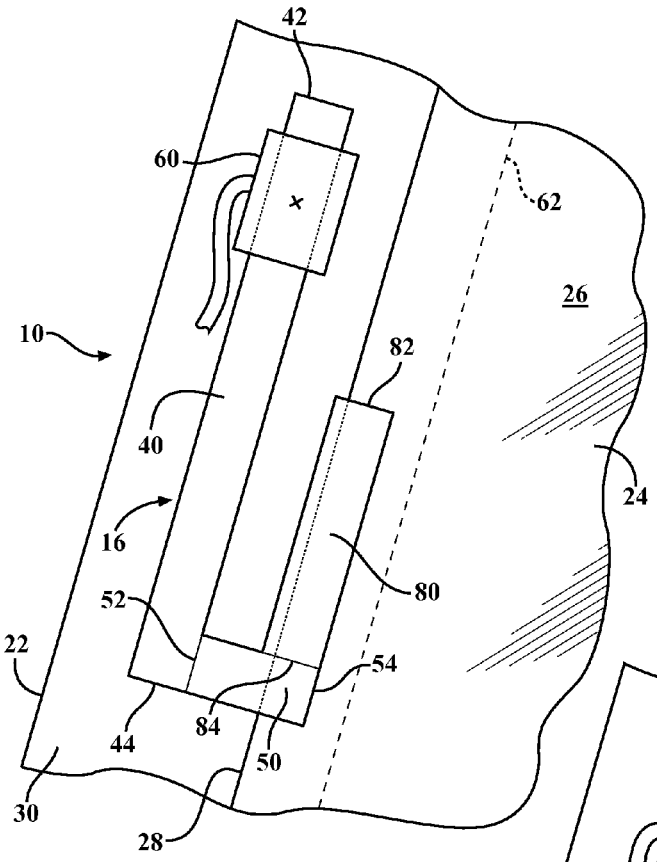
FIG. 15 is a plan view of the antenna element having the first and second antenna segments and a fourth antenna segment extending from the second antenna segment, according to one embodiment of the present invention.
Figure 16:
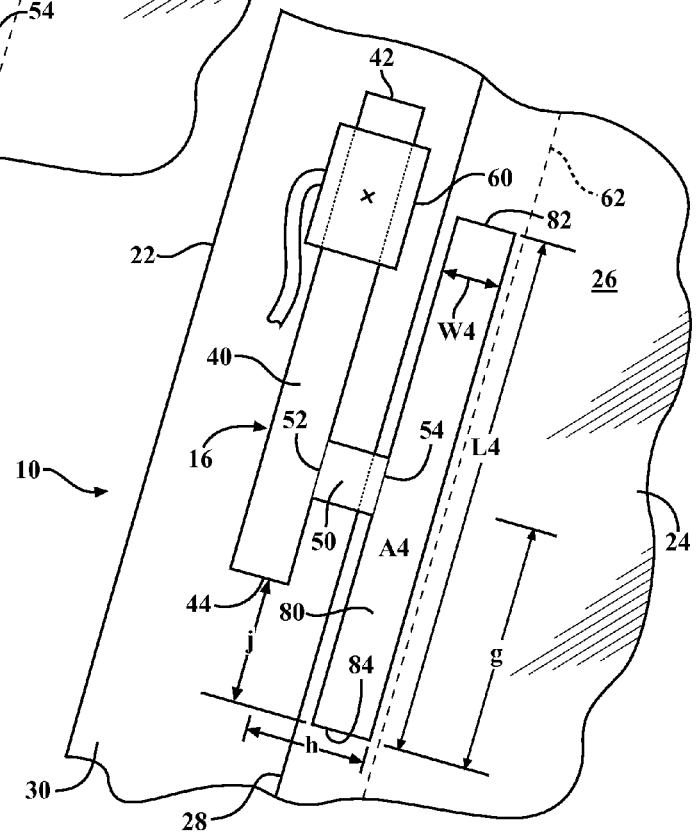
FIG. 16 is a plan view of the antenna element having the first, second and fourth antenna segments, according to another embodiment of the present invention.

As shown in FIGS. 15-18, the antenna element 16 may have a fourth antenna segment 80. The fourth antenna segment 80 extends from the second antenna segment 50. The fourth antenna segment 80 abuts and is in direct electrical connection with the transparent layer 24. As shown in FIG. 16, the fourth antenna segment 80 includes an area "A4 " having a length "L4 " and a width "W4." The length L4 and width W4 of the fourth antenna segment 80 may be any suitable dimensions. In one embodiment, the length L4 of the fourth antenna segment 80 is in a range between 5-25 cm. In other embodiments, the length L4 of the fourth antenna segment 80 is approximately 15 cm. In one embodiment, the width W4 of the fourth antenna segment 40 is in a range between 0.2-1 cm. In another embodiment, the width W4 of the fourth antenna segment 40 is approximately 0.5 cm.

The addition of the fourth antenna segment 80 generally provides greater flexibility to improve impedance of the window assembly 10 as compared with simpler configurations. As such, the window assembly 10 including the fourth antenna segment 80 generally exhibits an even wider transmission or reception bandwidth as compared with the window assembly 10 having the antenna element 16 having only the first and second antenna segments 40, 50 or the first, second, and third antenna segments 40, 50, 70.

Figure 17:
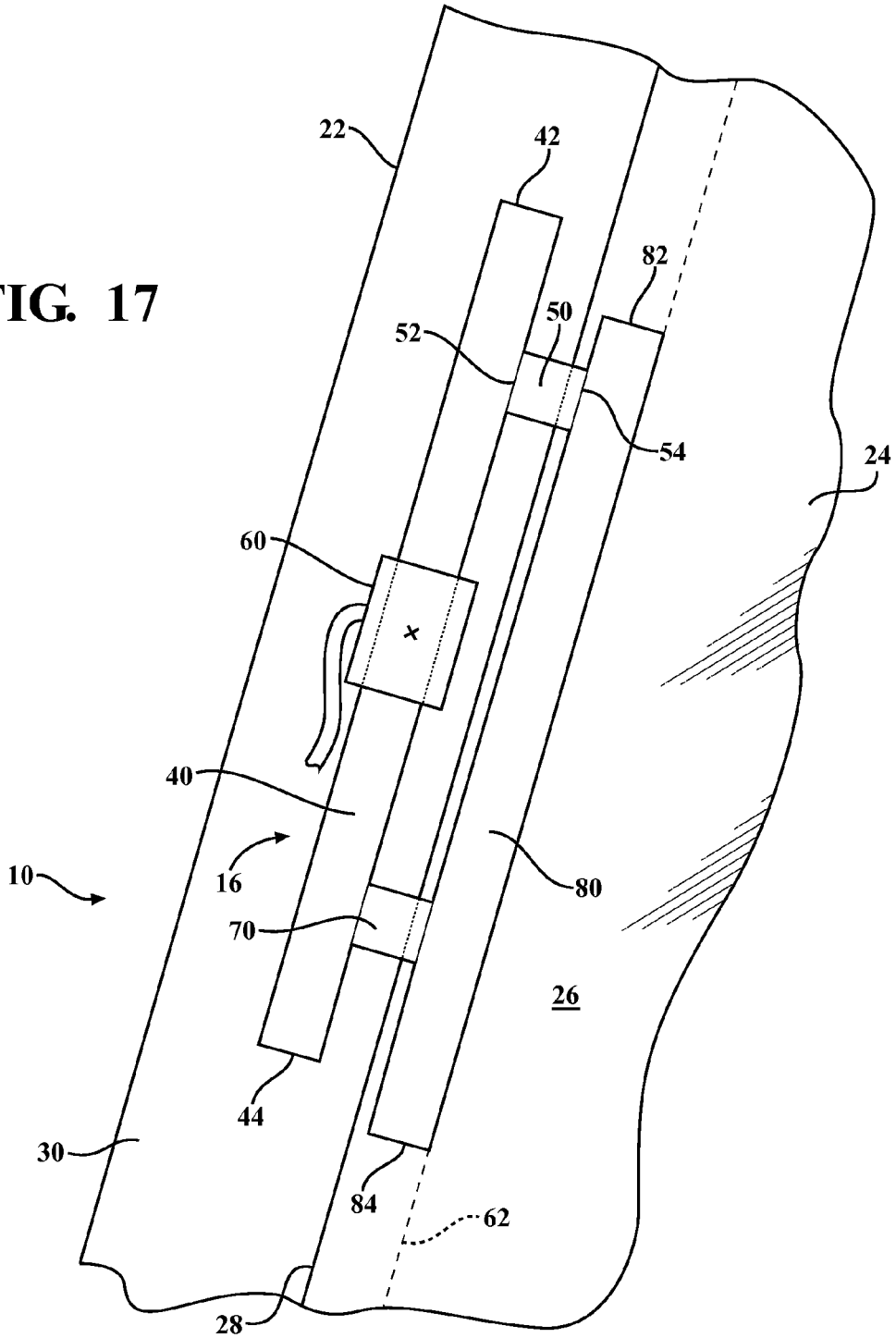
FIG. 17 is a plan view of the antenna element having the first, second and third antenna segments with the fourth antenna segment connecting to the second and third antenna segments, according to another embodiment of the present invention.
Figure 18:
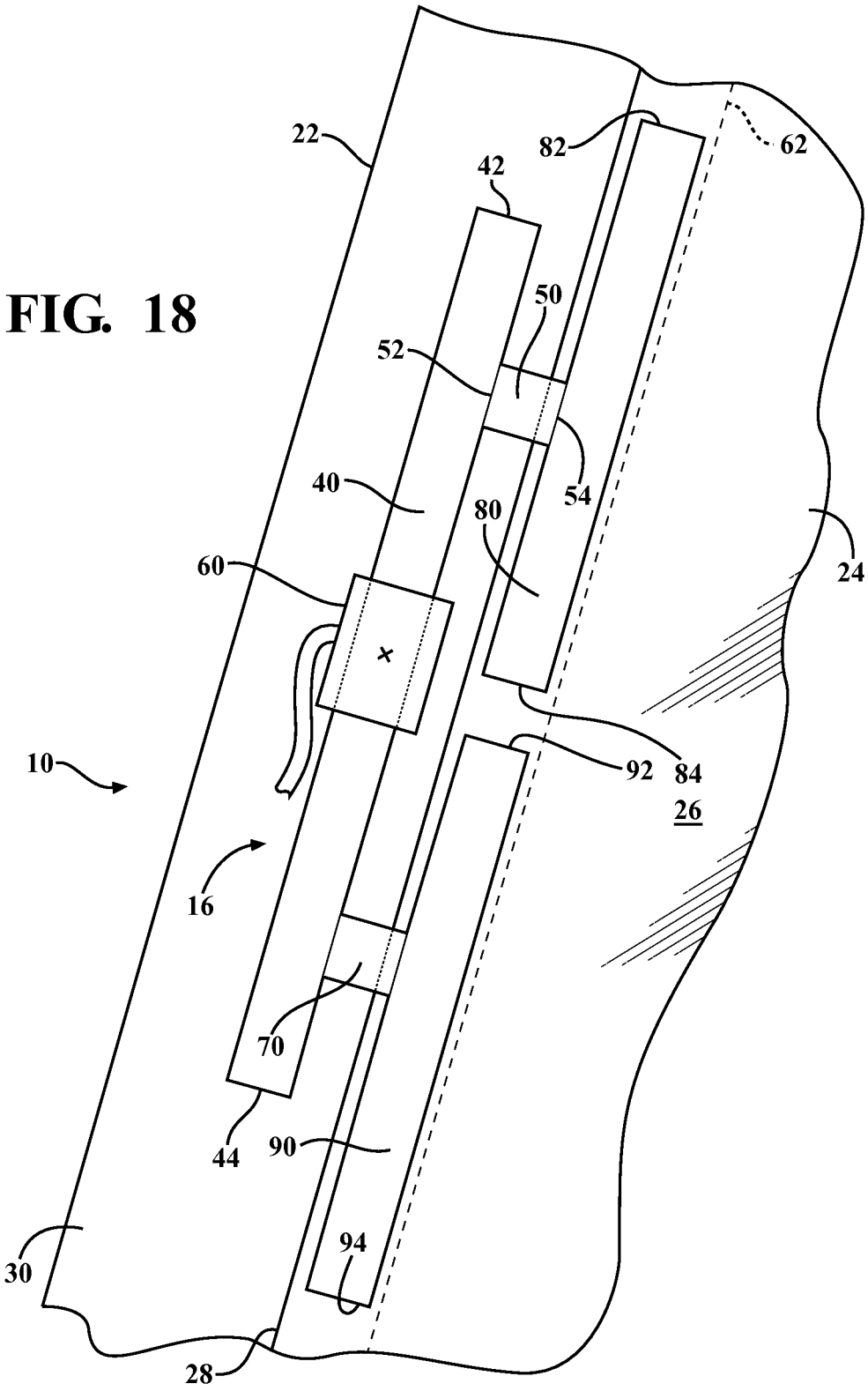
FIG. 18 is a plan view of the antenna element having the first, second, third and fourth antenna segments with a fifth antenna segment extending from the third antenna segment, according to another embodiment of the present invention.

In one embodiment, as shown in FIG. 16-18, the fourth antenna segment 80 is disposed entirely within the periphery 28 of the transparent layer 24. In another embodiment, as shown in FIG. 15, the fourth antenna segment 80 is disposed partially within the periphery 28 of the transparent layer 24 and partially in the outer region 30.

In FIGS. 15-18, the fourth antenna segment 80 extends perpendicular to the second antenna segment 50 and parallel to the first antenna segment 40. In FIG. 17, the fourth antenna segment 80 connects to both the second antenna segment 50 and the third antenna segment 70. In FIG. 17, the fourth antenna segment 80 extends perpendicularly from both the second antenna segment 50 and the third antenna segment 70.

The fourth antenna segment 80 includes a first end 82 and a second end 84 opposite the first end 82. In one embodiment, as shown in FIGS. 16-18 second antenna segment 50 connects to the fourth antenna segment 80 between the first and second ends 82, 84 of the fourth antenna segment 80. In such configurations, the second antenna segment 50 is spaced from each one of the first and second ends 82, 84 of the fourth antenna segment 80. In another embodiment, as shown in FIG. 15, the second antenna segment 50 connects to the fourth antenna segment 80 at one of the first and second ends 82, 84 of the fourth antenna segment 80. In such instances the second antenna segment 50 and the fourth antenna segment 80 have an L-shaped configuration. In yet another embodiment, as shown in FIG. 17, the second and third antenna segments 50, 70 connect to the fourth antenna segment 80 between the first and second ends 82, 84 of the fourth antenna segment 80 such that the each one of the second and third antenna segments 50, 70 are each spaced from the first and second ends 82, 84 of the fourth antenna segment 80. The fourth antenna segment 80 may extend according to other configurations without departing form the scope of the invention.

Antenna performance is further fine-tuned based upon the strategic dimensioning of the fourth antenna segment 80 and positioning of such in relation to the transparent layer 24 other antenna segments 40, 50, 70. For instance, as shown in FIG. 16, the length L4, width W4, and/or area A4 of the fourth antenna segment 80 may have a significant impact on antenna performance. As shown in FIG. 16, other examples of strategic positing and dimensioning of the fourth antenna segment 80 include (i) a distance "g" between the second antenna segment 50 and the first and/or second ends 82, 84 of the fourth antenna segment 80, (ii) a distance "h" between the first antenna segment 40 and the fourth antenna segment 80, and (iii) a distance "j" between one of the first and second ends 42, 44 of the first antenna segment 40 and a corresponding one of the first and second ends 82, 84 of the fourth antenna segment 80. Moreover, the length L4 of the fourth antenna segment 80 may be related to the length L1 of the first antenna segment 40 according to a predetermined ratio or fraction. For example, L1 may be twice as long as L4 in one embodiment. Alternatively, L4 may be one-fourth as long as L1 in another embodiment.

Many of the physical, mechanical, positional, dimensional, and functional properties of the first antenna segment 40 may be applied to the fourth antenna segment 80. Thus, for simplicity in description, those properties of the first antenna segment 40 described herein may be referenced to describe the fourth antenna segment 80. Of course, it is to be appreciated that the fourth antenna segment 80 is not necessarily identical to the first antenna segment 40 and each may exhibit different properties and provide unique advantages.

As shown in FIG. 18 the antenna element 16 may have a fifth antenna segment 90. The fifth antenna segment 90 extends from the third antenna segment 70. The fifth antenna segment 90 is spaced from the forth antenna segment 80. The fifth antenna segment 90 abuts and is in direct electrical connection with the transparent layer 24. The fifth antenna segment 90 includes a first end 92 and a second end 94 opposite the first end 92.

The addition of the fifth antenna segment 90 generally provides greater flexibility to improve impedance of the window assembly 10 as compared with simpler configurations. As such, the window assembly 10 including the fifth antenna segment 90 generally exhibits an even wider transmission or reception bandwidth as compared with the window assembly 10 having the antenna element 16 having only the first, second, third, and/or fourth antenna segments 40, 50, 70, 80.

Many of the physical, mechanical, positional, dimensional, and functional properties of the fourth antenna segment 80 may be applied to the fifth antenna segment 90. Thus, for simplicity in description, those properties of the fourth antenna segment 80 described herein may be referenced to describe the fifth antenna segment 90. Of course, it is to be appreciated that the fourth antenna segment 80 is not necessarily identical to the fifth antenna segment 90 as the fourth and fifth antenna segments 80, 90 may exhibit different properties and provide unique advantages.

In one embodiment, as shown in FIG. 1, the window assembly 10 includes two antenna elements 16. A signal processor 100 is connected to both antenna elements 16. The signal processor 100 is configured to select and/or combine radio frequency signals transmittable and/or receivable by the antenna elements 16. By doing so, the two antenna elements 16 operate in diversity. By operating in diversity, the antenna elements 16 transmit and/or receive radio frequency signals in multiple directions within a field of reception to minimize interference and temporary fading of the signal. In one example, the two antenna elements 16 in conjunction with the transparent layer 24 operate to transmit radio signals for TV applications.

In another embodiment, as shown in FIG. 2, the window assembly 10 includes a first, second, and third antenna element 16*a*, 16*b*, 16*c* each being disposed along the first edge 28*c* of the periphery 28 and a fourth, fifth, and sixth antenna element 16*d*, 16*e*, 16*f* each being disposed along the opposing second edge 28*d* of the periphery 28. The first, second, third, fourth, fifth, and sixth antenna elements 16*a*, 16*b*, 16*c*, 16*d*, 16*e*, and 16*f* each include a first antenna segment 40 and a second antenna segment 50. The first and fourth antenna elements 16*a*, 16*d* each further include a third antenna segment 70. The first antenna segment 40 of each of the antenna elements 16*a*, 16*b*, 16*c*, 16*d*, 16*e*, and 16*f* are elongated and disposed in the outer region 30 and spaced from the periphery 28. The first antenna segment 40 of each of the antenna elements 16*a*, 16*b*, 16*c*, 16*d*, 16*e*, and 16*f* extends substantially parallel to the periphery 28 and is spaced from the periphery 28. The second antenna segment 50 of each of the antenna elements 16*a*, 16*b*, 16*c*, 16*d*, 16*e*, and 16*f* extends substantially perpendicular from the first antenna segment 40 of each of the antenna elements 16*a*, 16*b*, 16*c*, 16*d*, 16*e*, and 16*f* toward the transparent layer 24 such that each of the second antenna segments 50 crosses the periphery 28 of the transparent layer 24. Each of the second antenna segments 50 abuts and is in direct electrical contact with the transparent layer 24. The third antenna segment 70 of each of the first and fourth antenna elements 16*a*, 16*d* are spaced from the second antenna segment 50 of each of the first and fourth antenna elements 16*a*, 16*d* and extend substantially perpendicular from the first antenna segment 40 of each of the first and fourth antenna elements 16*a*, 16*d* toward the transparent layer 24. Each of the third antenna segments 70 crosses the periphery 28 of the transparent layer 24 and abuts and is in direct electrical contact with the transparent layer 24. A plurality of feeding elements 60 are provided. Each of said antenna elements 16*a*, 16*b*, 16*c*, 16*d*, 16*e*, and 16*f* are coupled to one of the feeding elements 60 of the plurality.

In one modification of the embodiment in FIG. 2, a first feeding element 60*a* is coupled to the first antenna element 16*a* for energizing the first antenna element 16*a* and the transparent layer 24. A second feeding element 60*b* is coupled to both the second and third antenna elements 16*b*, 16*c* for energizing the first and second antenna elements 16*b*, 16*c* and the transparent layer 24. A third feeding element 60*c* is coupled to the fourth antenna element 16*d* for energizing the fourth antenna element 16*d* and the transparent layer 24. A fourth feeding element 60*d* is coupled to the fifth and sixth antenna elements 16*e*, 16*f* for energizing the fifth and sixth antenna elements 16*e*, 16*f* and the transparent layer 24.

In another modification of the embodiment of FIG. 2, the first antenna element 16*a* transmits and/or receives radio signals for TV applications, the second antenna element 16*b* transmits and/or receives radio signals for Remote Keyless Entry applications, the second antenna element 16*c* transmits and/or receives radio signals for FM or Digital Audio Broadcasting applications, the fourth antenna element 16*d* transmits and/or receives radio signals for TV applications, the fifth antenna element 16*e* transmits and/or receives radio signals for TV applications, the sixth antenna element 16*e* transmits and/or receives radio signals for FM or Digital Audio Broadcasting applications.

In yet another embodiment, as shown in FIG. 4, the transparent layer 24 is energizable as the defrosting or defogging element. The window assembly 10 includes a first antenna element 16*a* and a second antenna element 16*b* with the first antenna element 16*a* being disposed along the first edge 28*c* of the periphery 28 and the second antenna element 16*b* being disposed along the opposing second edge 28*d* of the periphery 28. Each of the first and second antenna elements 16*a*, 16*b* includes at least a first antenna segment 40 and a second antenna segment 50. The first antenna segment 40 of each of the first and second antenna elements 16*a*, 16*b* is elongated and disposed in the outer region 30 and spaced from the periphery 28. The first antenna segment 40 of the first antenna element 16*a* extends along the first edge 28*c* of the periphery 28. The first antenna segment 40 of the second antenna element 16*b* extends along the opposing second edge 28*d* of the periphery 28. The second antenna segment 50 of each of the first and second antenna elements 16*a* 16*b* extends from the first antenna segment 40 of each of the first and second antenna elements 16*a*, 16*b* toward the transparent layer 24 such that each of the second antenna segments 50 crosses the periphery 28 of the transparent layer 24 and with each of the second antenna segments 50 abutting and being in direct electrical contact with the transparent layer 24. A first feeding element 60*a* is coupled to the first antenna element 16*a* for energizing the first and second antenna segments 40, 50 of the first antenna element 16*a* and the transparent layer 24 such that the first and second antenna segments 40, 50 and the transparent layer 24 collectively transmit and/or receive radio frequency signals. A second feeding element 60*b* is coupled to the second antenna element 16*b* for energizing the first and second antenna segments 40, 50 of the second antenna element and the transparent layer such that the first and second antenna segments 40, 50 and the transparent layer 24 collectively transmit and/or receive radio frequency signals.

In another embodiment of FIG. 4, each of the first and second antenna elements 16*a*, 16*b* may each further include the third antenna segment 70. The third antenna segment 70 of each of the first and second antenna elements 16*a*, 16*b* is spaced from the second antenna segment 50 of each of the first and second antenna elements 16, 16*b* and extends from the first antenna segment 40 of each of the first and second antenna elements 16, 16*b* toward the transparent layer 24. Each of the third antenna segments 70 crosses the periphery 28 of the transparent layer 24. Each of the third antenna segments 70 abuts and is in direct electrical contact with the transparent layer 24. The first feeding element 60*a* is coupled to the first antenna element 16*a* for energizing the first, second, and third antenna segments 40, 50, 70 of the first antenna element 16*a* and the transparent layer 24 such that the first, second, and third antenna segments 40, 50, 70 and the transparent layer 24 collectively transmit and/or receive radio frequency signals. The second feeding element 60*b* is coupled to the second antenna element 16*b* for energizing the first, second, and third antenna segments 40, 50, 70 of the second antenna element and the transparent layer such that the first, second, and third antenna segments 40, 50, 70 and the transparent layer 24 collectively transmit radio frequency signals. In one embodiment, the window assembly 10 of FIG. 4 transmits radio frequency signals for TV applications.

Figure 19:
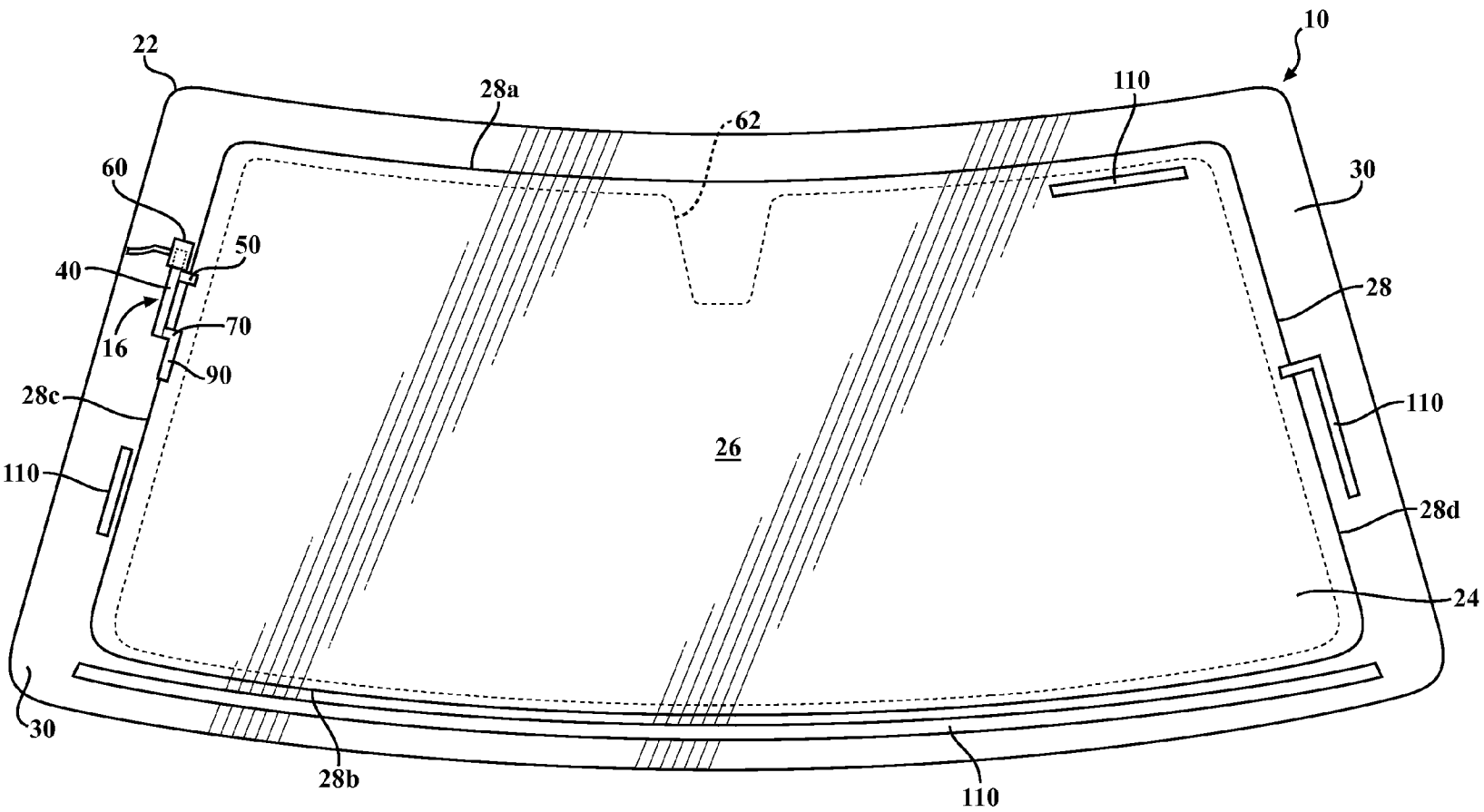
FIG. 19 is a plan view of the window assembly including the antenna element and a plurality of parasitic elements, according to one embodiment of the present invention.

As shown in FIG. 19, the window assembly 10 may include a parasitic element 110. The parasitic element 100 may be formed of a conductive material, such as a metallic print. The parasitic element 110 may have different configurations. In one embodiment, the parasitic element 110 has an elongated configuration. In another embodiment, the parasitic element 110 has an L-shaped configuration or a T-shaped configuration. The parasitic element 110 is spaced from the antenna element 16. The parasitic element 110 is does not abut the antenna element 16. In one embodiment, the parasitic element 110 is electrically disconnected from the transparent layer 24. In another embodiment, the parasitic element 110 is electrically connected to the transparent layer 24. Additionally, the parasitic element 110 may be disposed entirely in the outer region 30 such that the parasitic element 110 is surrounded by the outer region 30. Alternatively, the parasitic element 110 element may be disposed entirely within the periphery 28 of the transparent layer 24. Furthermore, the parasitic element 110 element may be disposed partially in the outer region 30 and partially within the periphery 28 of the transparent layer 24.

Figure 20:
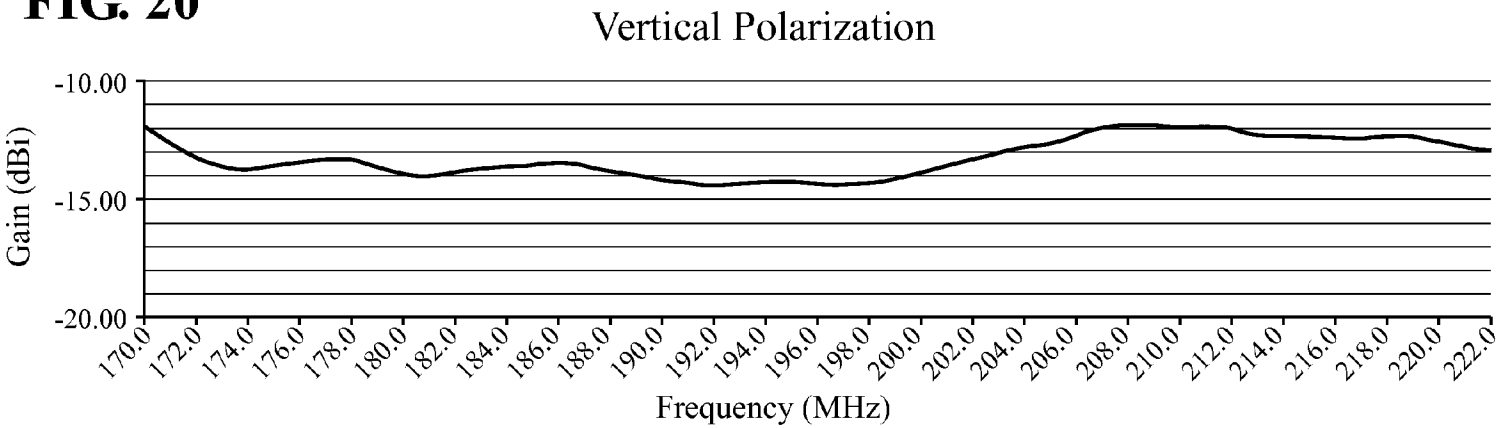
FIG. 20 is a chart illustrating antenna performance of the window assembly, according to one embodiment of the present invention.
Figure 21:
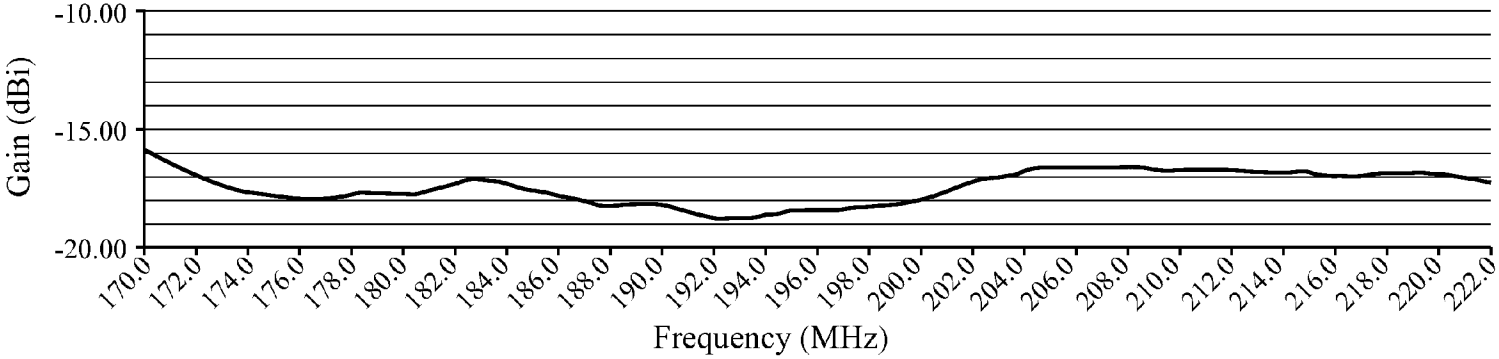
FIG. 21 is a chart illustrating antenna performance of the window assembly, according to one embodiment of the present invention.

FIGS. 20 and 21 are charts illustrating antenna performance of the window assembly 10 according to one embodiment of the present invention. The chart in FIG. 20 illustrates antenna performance where vertical polarization is utilized. The chart in FIG. 21 illustrates antenna performance where horizontal polarization is utilized. The antenna performance in both FIGS. 20 and 21 was measured in the VHF range. More specifically, the antenna performance was measured in the TV application range of 170-222 MHz's FIGS. 20 and 21 illustrate antenna gain measured in dBi (isotropic). As shown in FIG. 20, the window assembly 10 exhibited gains greater than −15 dBi throughout the given frequency range at vertical polarization. As shown in FIG. 21, the window assembly 10 exhibited gains greater than −20 dBi throughout the given frequency range at horizontal polarization. In both FIGS. 20 and 21, the gain exhibited is substantially consistent across the given frequency range. Examples of such embodiments that may exhibit such antenna performance include, but are not limited to, the window assembly 10 of FIG. 2. More specifically, any given one, or a combination of antenna elements 16*a*, 16*d* and 16*e* may receive radio frequency signals in the TV application range of 170-222 MHz and exhibit such advantageous results.

The present invention has been described herein in an illustrative manner. It is to be understood that the terminology which has been used is intended to be in the nature of words of description rather than of limitation. Obviously, many modifications and variations of the invention are possible in light of the above teachings. The invention may be practiced otherwise than as specifically described within the scope of the appended claims.

What is claimed is:

1. A window assembly comprising:

a substrate;

a transparent layer disposed on said substrate and defining an area having a periphery and with said transparent layer comprising a metal compound such that said transparent layer is electrically conductive;

an outer region devoid of said transparent layer defined adjacent said transparent layer along said periphery;

an antenna element disposed on said substrate and including a first antenna segment and a second antenna segment, wherein said first and second antenna segments are comprised of a metallic print;

said first antenna segment disposed in said outer region and spaced from said periphery with said first antenna segment being elongated and extending along said periphery;

said second antenna segment extending from said first antenna segment toward said transparent layer such that said second antenna segment crosses said periphery of said transparent layer with said second antenna segment abutting and being in direct electrical contact with said transparent layer; and a feeding element coupled to said antenna element for energizing said first and second antenna segments and said transparent layer such that said first and second antenna segments and said transparent layer collectively transmit and/or receive radio frequency signals.

2. A window assembly as set forth in claim 1, wherein said first antenna segment extends substantially parallel to said periphery and includes a first end and a second end opposite said first end.

3. A window assembly as set forth in claim 1, wherein said first antenna segment and said second antenna segment each define a length with said length of said first antenna segment being longer than said length of said second antenna segment.

4. A window assembly as set forth in claim 1, wherein said feeding element is disposed in said outer region and spaced from said transparent layer.

5. A window assembly as set forth in claim 2, wherein said feeding element is coupled to said first antenna segment between said first and second ends of said first antenna segment such that said feeding element is spaced from each one of said first and second ends of said first antenna segment.

6. A window assembly as set forth in claim 2, wherein said feeding element is coupled to said first antenna segment at one of said first and second ends of said first antenna segment.

7. A window assembly as set forth in claim 2, wherein said second antenna segment extends substantially perpendicular from said first antenna segment.

8. A window assembly as set forth in claim 2, wherein said second antenna segment extends from said first antenna segment between said first and second ends of said first antenna segment such that said second antenna segment is spaced from each one of said first and second ends of said first antenna segment.

9. A window assembly as set forth in claim 2, wherein said second antenna segment extends from said first antenna segment at one of said first and second ends of said first antenna segment such that said first and second antenna segments have an L-shaped configuration.

10. A window assembly as set forth in claim 2, wherein said antenna element includes a third antenna segment extending substantially perpendicular from said first antenna segment toward said transparent layer such that said third antenna segment crosses said periphery and with said third antenna segment abutting and being in direct electrical contact with said transparent layer.

11. A window assembly as set forth in claim 10, wherein said third antenna segment extends from said first antenna segment between said first and second ends of said first antenna segment such that said third antenna segment is spaced from each one of said first and second ends of said first antenna segment.

12. A window assembly as set forth in claim 10, wherein said third antenna segment extends from said first antenna segment at one of said first and second ends of said first antenna segment.

13. A window assembly as set forth in claim 12, wherein said second antenna segment extends from said first antenna segment at one of said first and second ends of said first antenna segment and said third antenna segment extends from said first antenna segment at said other one of said first and second ends of said first antenna segment such that said antenna element has a C-shaped configuration.

14. A window assembly as set forth in claim 1, wherein said antenna element is configured to transmit and/or receive radio frequency signals for at least one of Remote Keyless Entry (RKE), Digital Audio Broadcasting (DAB), FM, cellular and TV applications.

15. A window assembly as set forth in claim 1, wherein said first and second antenna segments are configured to provide at least one of impedance matching and radiation pattern altering.

16. A window assembly as set forth in claim 1, wherein said feeding element is spaced from and capacitively coupled to said antenna element.

17. A window assembly as set forth in claim 1, wherein said antenna element and said feeding element are integrated into a single component.

18. A window assembly as set forth in claim 1, wherein said antenna element and said transparent layer each have an electrical conductivity wherein said electrical conductivity of said antenna element is of a higher order of magnitude than said electrical conductivity of said transparent layer.

19. A window assembly as set forth in claim 1, wherein said transparent layer is a defrosting or defogging element.

20. A window assembly comprising:

a substrate;

a transparent layer disposed on said substrate and defining an area having a periphery and with said transparent layer comprising a metal compound such that said transparent layer is electrically conductive;

an outer region devoid of said transparent layer defined adjacent said transparent layer along said periphery;

an antenna element disposed on said substrate and including a first antenna segment and a second antenna segment;

said first antenna segment disposed in said outer region and spaced from said periphery with said first antenna segment being elongated and extending along said periphery;

said second antenna segment extending from said first antenna segment toward said transparent layer such that said second antenna segment crosses said periphery of said transparent layer with said second antenna segment abutting and being in direct electrical contact with said transparent layer; and a feeding element coupled to said antenna element for energizing said first and second antenna segments and said transparent layer such that said first and second antenna segments and said transparent layer collectively transmit and/or receive radio frequency signals and wherein said antenna element and said feeding element are integrated into a single component.

21. A window assembly as set forth in claim 20, wherein said first antenna segment extends substantially parallel to said periphery and includes a first end and a second end opposite said first end.

22. A window assembly as set forth in claim 20, wherein said first antenna segment and said second antenna segment each define a length with said length of said first antenna segment being longer than said length of said second antenna segment.

23. A window assembly as set forth in claim 20, wherein said feeding element is disposed in said outer region and spaced from said transparent layer.

24. A window assembly as set forth in claim 21, wherein said feeding element is coupled to said first antenna segment between said first and second ends of said first antenna segment such that said feeding element is spaced from each one of said first and second ends of said first antenna segment.

25. A window assembly as set forth in claim 21, wherein said feeding element is coupled to said first antenna segment at one of said first and second ends of said first antenna segment.

26. A window assembly as set forth in claim 21, wherein said second antenna segment extends substantially perpendicular from said first antenna segment.

27. A window assembly as set forth in claim 21, wherein said second antenna segment extends from said first antenna segment between said first and second ends of said first antenna segment such that said second antenna segment is spaced from each one of said first and second ends of said first antenna segment.

28. A window assembly as set forth in claim 21, wherein said second antenna segment extends from said first antenna segment at one of said first and second ends of said first antenna segment such that said first and second antenna segments have an L-shaped configuration.

29. A window assembly as set forth in claim 21, wherein said antenna element includes a third antenna segment extending substantially perpendicular from said first antenna segment toward said transparent layer such that said third antenna segment crosses said periphery and with said third antenna segment abutting and being in direct electrical contact with said transparent layer.

30. A window assembly as set forth in claim 29, wherein said third antenna segment extends from said first antenna segment between said first and second ends of said first antenna segment such that said third antenna segment is spaced from each one of said first and second ends of said first antenna segment.

31. A window assembly as set forth in claim 29, wherein said third antenna segment extends from said first antenna segment at one of said first and second ends of said first antenna segment.

32. A window assembly as set forth in claim 31, wherein said second antenna segment extends from said first antenna segment at one of said first and second ends of said first antenna segment and said third antenna segment extends from said first antenna segment at said other one of said first and second ends of said first antenna segment such that said antenna element has a C-shaped configuration.

33. A window assembly as set forth in claim 20, wherein said antenna element is configured to transmit and/or receive radio frequency signals for at least one of Remote Keyless Entry (RKE), Digital Audio Broadcasting (DAB), FM, cellular and TV applications.

34. A window assembly as set forth in claim 20, wherein said first and second antenna segments are configured to provide at least one of impedance matching and radiation pattern altering.

35. A window assembly as set forth in claim 20, wherein said feeding element is spaced from and capacitively coupled to said antenna element.

36. A window assembly as set forth in claim 20, wherein said antenna element and said transparent layer each have an electrical conductivity wherein said electrical conductivity of said antenna element is of a higher order of magnitude than said electrical conductivity of said transparent layer.

37. A window assembly as set forth in claim 20, wherein said transparent layer is a defrosting or defogging element.

38. A window assembly comprising:

a substrate;

a transparent layer disposed on said substrate and defining an area having a periphery and with said transparent layer comprising a metal compound such that said transparent layer is electrically conductive;

an outer region devoid of said transparent layer defined adjacent said transparent layer along said periphery;

an antenna element disposed on said substrate and including;

a first antenna segment disposed in said outer region and spaced from said periphery with said first antenna segment being elongated and extending substantially parallel to said periphery;

a second antenna segment and a third antenna segment each extending from said first antenna segment toward said transparent layer such that each of said second and third antenna segments crosses said periphery of said transparent layer with said second and third antenna segments each abutting and being in direct electrical contact with said transparent layer;

a fourth antenna segment extending substantially perpendicular from said second antenna segment and substantially parallel to said first antenna segment with said fourth antenna segment including a first end and a second end opposite said first end with said fourth antenna segment abutting and being in direct electrical contact with said transparent layer and wherein said second antenna segment connects to said fourth antenna segment between said first and second ends of said fourth antenna segment such that said second antenna segment is spaced from each one of said first and second ends of said fourth antenna segment; and a feeding element coupled to said antenna element for energizing said antenna element and said transparent layer such that said antenna element and said transparent layer collectively transmit and/or receive radio frequency signals.

39. A window assembly comprising:

a substrate;

a transparent layer disposed on said substrate and defining an area having a periphery and with said transparent layer comprising a metal compound such that said transparent layer is electrically conductive;

an outer region devoid of said transparent layer defined adjacent said transparent layer along said periphery;

an antenna element disposed on said substrate and including;

a first antenna segment disposed in said outer region and spaced from said periphery with said first antenna segment being elongated and extending substantially parallel to said periphery;

a second antenna segment and a third antenna segment each extending from said first antenna segment toward said transparent layer such that each of said second and third antenna segments crosses said periphery of said transparent layer with said second and third antenna segments each abutting and being in direct electrical contact with said transparent layer;

a fourth antenna segment extending substantially perpendicular from said second antenna segment and substantially parallel to said first antenna segment with said fourth antenna segment including a first end and a second end opposite said first end with said fourth antenna segment abutting and being in direct electrical contact with said transparent layer and wherein said second antenna segment connects to said fourth antenna segment at one of said first and second ends of said fourth antenna segment such that said second antenna segment and said fourth antenna segment have an L-shaped configuration; and a feeding element coupled to said antenna element for energizing said antenna element and said transparent layer such that said antenna element and said transparent layer collectively transmit and/or receive radio frequency signals.

* * * * *